US012104816B2

(12) United States Patent
Weng et al.

(10) Patent No.: US 12,104,816 B2
(45) Date of Patent: Oct. 1, 2024

(54) CONTROL METHOD, CONTROL DEVICE, AIR CONDITIONER SYSTEM AND STORAGE MEDIUM WITH CONTROL PARAMETER DETERMINED BASED ON HISTORICAL OPERATION RECORD

(71) Applicants: GD MIDEA AIR-CONDITIONING EQUIPMENT CO., LTD., Foshan (CN); MIDEA GROUP CO., LTD., Foshan (CN)

(72) Inventors: Jinlian Weng, Foshan (CN); Huanle Zhang, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 482 days.

(21) Appl. No.: 17/440,600

(22) PCT Filed: Apr. 25, 2019

(86) PCT No.: PCT/CN2019/084288
§ 371 (c)(1),
(2) Date: Sep. 17, 2021

(87) PCT Pub. No.: WO2020/186600
PCT Pub. Date: Sep. 24, 2020

(65) Prior Publication Data

US 2022/0154963 A1 May 19, 2022

(30) Foreign Application Priority Data

Mar. 21, 2019 (CN) ..... 201910220732.4
Mar. 21, 2019 (CN) ..... 201910221135.3

(51) Int. Cl.
*F24F 11/64* (2018.01)
*F24F 11/52* (2018.01)

(52) U.S. Cl.
CPC ..... *F24F 11/64* (2018.01); *F24F 11/52* (2018.01)

(58) Field of Classification Search
CPC ..... F24F 11/64; F24F 11/52
(Continued)

(56) References Cited

U.S. PATENT DOCUMENTS

2003/0070440 A1* 4/2003 Seong ..... F24F 11/30 236/51
2012/0006525 A1* 1/2012 Lafleur ..... F24F 11/64 165/238
(Continued)

FOREIGN PATENT DOCUMENTS

CN 104296322 A 1/2015
CN 104833038 A 8/2015
(Continued)

OTHER PUBLICATIONS

The European Patent Office (EPO) Extended Search Report for EP Application No. 19920354.8 Jun. 17, 2022 13 Pages.
(Continued)

*Primary Examiner* — Jigneshkumar C Patel
(74) *Attorney, Agent, or Firm* — Anova Law Group, PLLC

(57) ABSTRACT

A control method includes obtaining historical operation records for a plurality of indoor units of an air conditioner system, and determining control parameters of the at least two indoor units according to the historical operation records to control the at least two indoor units. The air conditioner system further includes an outdoor unit.

19 Claims, 13 Drawing Sheets

(58) Field of Classification Search
USPC ..... 700/276
See application file for complete search history.

(56) References Cited

U.S. PATENT DOCUMENTS

| | | | | |
|---|---|---|---|---|
| 2017/0211830 | A1 | 7/2017 | Kosaka et al. | |
| 2019/0017722 | A1* | 1/2019 | Suzuki | F25B 13/00 |

FOREIGN PATENT DOCUMENTS

| | | | |
|---|---|---|---|
| CN | 105135633 | A | 12/2015 |
| CN | 105423500 | A | 3/2016 |
| CN | 205066042 | U | 3/2016 |
| CN | 105611017 | A | 5/2016 |
| CN | 105374126 | B | 12/2017 |
| CN | 105135633 | B | 2/2018 |
| CN | 104633865 | B | 3/2018 |
| EP | 3418643 | A1 | 12/2018 |
| IN | 109269033 | A | 1/2019 |
| JP | H11248235 | A | 9/1999 |
| JP | 2015048957 | A | 3/2015 |
| JP | 2018071811 | A | 5/2018 |
| KR | 20070068867 | A | 7/2007 |
| KR | 20140046293 | A | 4/2014 |
| WO | 2017056403 | A1 | 4/2017 |

OTHER PUBLICATIONS

World Intellectual Property Organization (WIPO) International Search Report and Written opinion for PCT/CN2019/084288 Nov. 29, 2019 14 Pages (Translation Included).

The China National Intelleectual Property Administration (CNIPA) The First Office Action for 201910220732.4 Dec. 11, 2019 9 Pages (Translation Included).

The China National Intelleectual Property Administration (CNIPA) The First Office Action for 201910221135.3 Dec. 5, 2019 15 Pages (Translation Included).

The China National Intelleectual Property Administration (CNIPA) The Second Office Action for 201910221135.3 Apr. 9, 2020 8 Pages (Translation Included).

* cited by examiner

CONTROL METHOD, CONTROL DEVICE, AIR CONDITIONER SYSTEM AND STORAGE MEDIUM WITH CONTROL PARAMETER DETERMINED BASED ON HISTORICAL OPERATION RECORD

CROSS-REFERENCE TO RELATED APPLICATIONS

This application is a National Stage Entry under 35 U.S.C. § 371 of International Application No. PCT/CN2019/084288, filed on Apr. 25, 2019, which claims priority to Chinese Patent Application No. 201910221135.3, filed on Mar. 21, 2019, entitled "CONTROL METHOD, CONTROL DEVICE, AIR CONDITIONER SYSTEM, AND STORAGE MEDIUM," and Chinese Patent Application No. 201910220732.4, filed on Mar. 21, 2019, entitled "QUICK CONTROL METHOD OF AIR CONDITIONER SYSTEM, TERMINAL, AIR CONDITIONER SYSTEM, AND MEDIUM," the entire disclosures of all of which are incorporated herein by reference.

TECHNICAL FIELD

The present disclosure relates to the technical field of air conditioners, and in particular to a control method, a control device, an air conditioner system, and a computer-readable storage medium.

BACKGROUND

Nowadays, an air conditioner system only needs one outdoor unit, which can be connected to multiple indoor units simultaneously (such as an air conditioner with one outdoor unit and multiple indoor units), saving outdoor unit apparatus and installation space, and meeting the air conditioning needs of multiple rooms. However, since each indoor unit operates according to the corresponding operation parameters thereof, when the user needs to adjust the operation parameters of different indoor units, or needs to control the operation of multiple indoor units simultaneously, it is needed to set the control parameters of the indoor units one by one, which is inconvenient for the user to control the air conditioner system with multiple indoor units.

SUMMARY

The main objective of the present disclosure is to provide a control method, a control device, an air conditioner system, and a computer-readable storage medium, so that the user can control an air conditioner system with multiple indoor units.

In order to achieve the above objective, the present disclosure provides a control method, applied to a control device with a touch display unit, wherein the control device is configured to control an air conditioner system to operate, the air conditioner system includes one outdoor unit and at least two indoor units, and the control method includes following operations:

obtaining historical operation records for the at least two indoor units; and determining control parameters of the at least two indoor units according to the historical operation records to control the at least two indoor units.

Optionally, the operation of determining control parameters of the at least two indoor units according to the historical operation records to control the at least two indoor units includes:

respectively generating a first control set of each indoor unit according to the historical operation records, the first control set including at least two control functions, and control parameters corresponding to the at least two control functions; and controlling the at least two indoor units to operate with the corresponding control parameters in the first control set.

Optionally, the operation of determining control parameters of the at least two indoor units according to the historical operation records to control the at least two indoor units includes:

generating a second control set according to the historical operation records, the second control set being associated with the at least two indoor units and control parameters corresponding to the at least two indoor units; and controlling the at least two indoor units to operate with the corresponding control parameters in the second control set.

Optionally, the operation of generating a second control set according to the historical operation records, the second control set being associated with the at least two indoor units and control parameters corresponding to the at least two indoor units includes:

respectively generating a first control set of each indoor unit according to the historical operation records, the first control set including at least one control function, and control parameters corresponding to the at least one control function; and obtaining the first control sets of the at least two indoor units that are controlled simultaneously, to generate the second control set.

Optionally, the historical operation records include at least one of control times of the control parameters, control durations of the control parameters, control periods of the control parameters, or control environment information of the control parameters, wherein the control environment information includes at least one of environment temperature, environment humidity, or PM2.5 value.

Optionally, the operation of respectively generating a first control set of each indoor unit according to the historical operation records, the first control set including at least two control functions, and control parameters corresponding to the at least two control function includes:

when the control times of the control parameters corresponding to at least two control functions are greater than a preset threshold, and/or the control durations of the control parameters corresponding to the control functions are greater than a preset duration, generating the first control set, and adding control parameters corresponding to at least two control functions to the first control set.

Optionally, the operation of respectively generating a first control set of each indoor unit according to the historical operation records, the first control set including at least two control functions, and control parameters corresponding to the at least two control functions includes:

selecting control parameters of at least two different control functions to generate the first control set according to the control times or the control durations of all the control parameters of the at least two indoor units, wherein the selected control parameter has a largest number of control times or a longest control duration among the control parameters in the corresponding control function.

Optionally, the operation of respectively generating a first control set of each indoor unit according to the historical operation records, the first control set including at least one control function, and control parameters corresponding to the at least one control function includes:

selecting control parameters of at least one control function to generate the first control set according to the control times or the control durations of all the control parameters of the at least two indoor units, wherein the selected control parameter has a largest number of control times or a longest control duration among the control parameters in the corresponding control function.

Optionally, the control method further includes:

when counting the control times of the control parameters, taking control times at different control environment information among the control times of the same control parameter as different control times.

Optionally, the operation of respectively generating a first control set of each indoor unit according to the historical operation records, the first control set including at least two control functions, and control parameters corresponding to the at least two control functions includes:

obtaining a current time; and when control periods of control parameters corresponding to at least two control functions in the indoor unit correspond to the current time, generating the first control set, and adding control parameters corresponding to the at least two control functions to the first control set.

Optionally, the operation of respectively generating a first control set of each indoor unit according to the historical operation records, the first control set including at least one control function, and control parameters corresponding to the at least one control function includes:

obtaining a current time; and generating the first control set according to the control period of the control parameters corresponding to the at least one control function within which the current time is located, and adding control parameters corresponding to the control period to the first control set.

Optionally, the operation of controlling the at least two indoor units to operate with the corresponding control parameters in the first control set includes:

generating a control button corresponding to the control parameters in the first control set on the control interface of the air conditioner system, the control button being associated with an indoor unit corresponding to the first control set;

in response to detecting that the control button on the control interface is triggered, obtaining the control parameters corresponding to the control button; and controlling the indoor unit associated with the control button to operate with the control parameters.

Optionally, the control method further includes:

in response to generation of the first control set, generating a prompt message about whether to generate the control button corresponding to the first control set; and in response to receiving a confirmation for generating the control button corresponding to the first control set, generating the control button on the control interface.

Optionally, the operation of controlling the at least two indoor units to operate with the corresponding control parameters in the second control set includes:

generating a control button corresponding to the control parameters in the second control set on the control interface of the air conditioner system, the control button being associated with at least two indoor units corresponding to the second control set;

in response to detecting that the control button on the control interface is triggered, obtaining the control parameters corresponding to the control button; and controlling each indoor unit associated with the control button to operate with the corresponding control parameters.

Optionally, the control method further includes:

in response to generation of the second control set, generating a prompt message about whether to generate the control button corresponding to the second control set; and in response to receiving a confirmation for generating the control button corresponding to the second control set, generating the control button on the control interface.

Optionally, after the operation of controlling the at least two indoor units to operate with the corresponding control parameters in the first control set, the control method further includes:

in response to an adjustment operation for control parameters of an indoor unit, updating associated control parameters in the first control set according to the adjusted control parameters.

Optionally, the operation of controlling the at least two indoor units to operate with the corresponding control parameters in the second control set includes:

in response to an adjustment operation for control parameters of an indoor unit, updating control parameters corresponding to the indoor unit in the second control set according to the adjusted control parameters.

Optionally, the control device is configured to control an air conditioner system to operate, the air conditioner system includes one outdoor unit and at least two indoor units, and the control method includes following operations:

the indoor unit receiving control parameters, wherein the control device obtains historical operation records for the at least two indoor units, determines control parameters of the at least two indoor units according to the historical operation records to control the at least two indoor units, and sends the control parameters to the indoor unit;

the indoor unit operates with the control parameters.

Optionally, the control device is configured to control an air conditioner system to operate, the air conditioner system includes one outdoor unit and at least two indoor units, and the control method includes following operations:

the air conditioner system receiving indoor unit information and control parameters, wherein the control device obtains historical operation records for the at least two indoor units, determines the control parameters of the at least two indoor units according to the historical operation records, and sends the control parameters and the indoor unit information of the at least two indoor units corresponding to the control parameters to the air conditioner system;

the air conditioner system controlling the at least two indoor units corresponding to the indoor unit information to operate according to the control parameters.

Optionally, the control method further includes:

providing a selection interface for selecting multiple indoor units; and using indoor units selected in the selection interface as the indoor units to be controlled simultaneously in response to receiving a confirmation instruction.

Optionally, the control method further includes:

in response to receiving an editing instruction of the control button, generating an editing interface according to an indoor unit identification of the indoor unit corresponding to the control button and the control parameters; and in response to receiving a response instruction to confirm editing, updating the control button, and saving a corresponding edited relationship between the indoor unit identification, the control parameters and the control button.

Optionally, the editing interface provides options of associating the indoor units and the control button, when a selection operation of an option is detected, an indoor unit identification of an indoor unit corresponding to the option is used as the edited indoor unit identification.

Optionally, the editing interface provides setting options for the control parameters of the indoor units, and in response to detecting an adjustment operation for the control parameters triggered based on the setting options, the adjusted control parameters are used as the edited control parameters.

In order to achieve the above objective, the present disclosure further provides a control device, including a touch display unit, a memory, a processor, and a control program stored in the memory and executable on the processor, when the control program is executed by the processor, the processor is caused to implement the operations of the control method as described above.

In order to achieve the above objective, the present disclosure further provides an air conditioner system, including an outdoor unit, at least two indoor units, a memory, a processor, and a control program stored in the memory and executable on the processor, wherein when the control program is executed by the processor, the processor is caused to implement the operations of the control method as described above.

In order to achieve the above objective, the present disclosure further provides an air conditioner system, including a data converter, one outdoor unit, and at least two indoor units. The outdoor unit is connected to the indoor unit, the data converter is connected to the outdoor unit, or the data converter is connected between the outdoor unit and the indoor unit. The air conditioner system includes a memory, a processor, and a control program stored in the memory and executable on the processor, when the control program is executed by the processor, the processor is caused to implement the operations of the control method as described above.

In order to achieve the above objective, the present disclosure further provides a computer-readable storage medium, a control program is stored in the computer-readable storage medium, when the control program is executed by a processor, the processor is caused to implement the operations of the control method as described above.

One or more technical solutions provided by the embodiments of the present disclosure have at least the following technical effects or advantages:

1. The user's setting information/habits of the control parameters of the indoor units of the air conditioner system are recorded every time. After the user performs centralized control operations of the indoor units many times, the same control parameters of multiple same indoor units frequently used by the user are set as a shortcut. When the user starts the same operation of multiple same indoor units next time, there is no need to complete it through the centralized control function, it is just needed to start the shortcut, which is convenient for the user to control the air conditioner system with multiple indoor units.

2. The user's setting information/habits of control parameters on the operation interface of an indoor unit are recorded every time. After the user has set the control parameters many times, the control button for setting the control parameters of the indoor unit is generated on the control interface, such that when the user needs to perform the same operation next time, the user does not need to enter the operation interface of the indoor unit, and directly sets the control parameters on the control interface, which is convenient for the user to control the air conditioner system with multiple indoor units.

3. The unified setting of the control parameters of multiple indoor units of the air conditioner system is realized. The user can set the control parameters of the currently selected indoor units uniformly, and control all the selected indoor units to operate with the currently adjusted control parameters, which improves the user's efficiency in controlling multiple indoor units simultaneously.

4. The control button for a specific function of the indoor unit is generated on the control interface in advance, such that the user only needs to press the control button on the control interface to realize the control parameters setting of a specific function of the indoor unit, and make the indoor unit operate with the control parameters. In this way, the control parameters of the indoor unit can be quickly set, so that the user can control the indoor unit without entering a specific operation interface of the indoor unit, thereby facilitating the user to control the air conditioner system with multiple indoor units.

The realization of the objective, functional characteristics, and advantages of the present disclosure are further described with reference to the accompanying drawings.

DETAILED DESCRIPTION OF THE EMBODIMENTS

It should be understood that the specific embodiments described herein are only used to explain the present disclosure, and are not intended to limit the present disclosure.

The present disclosure provides a control method, which is convenient for the user to control the air conditioner system with multiple indoor units.

Figure 1:
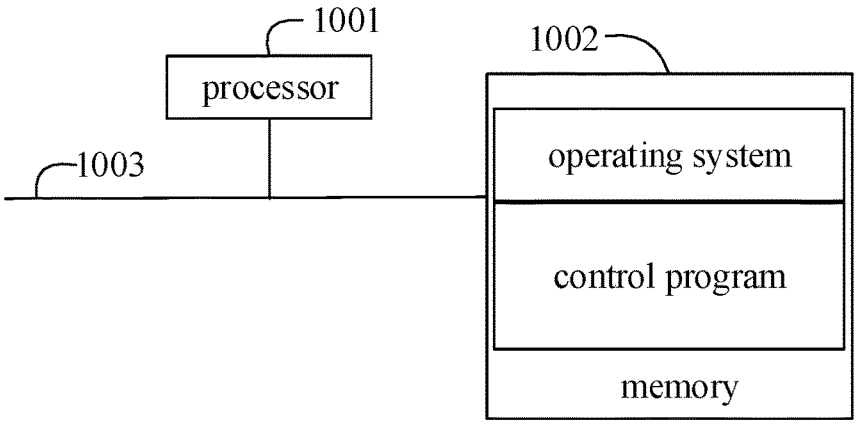
FIG. 1 is a schematic diagram of a hardware operating environment of a terminal according to an embodiment of the present disclosure.

As shown in FIG. 1, FIG. 1 is a schematic diagram of a hardware operating environment of a terminal according to an embodiment of the present disclosure.

In order to better understand the above technical solutions, the exemplary embodiments of the present disclosure will be described in more detail below with reference to the accompanying drawings. Although the drawings show exemplary embodiments of the present disclosure, it should be understood that the present disclosure can be implemented in various forms and should not be limited by the embodiments set forth herein. On the contrary, these embodiments are provided to enable a more thorough understanding of the present disclosure and to fully convey the scope of the present disclosure to those skilled in the art.

As shown in FIG. 1, the terminal can include a processor 1001, such as a central processing unit (CPU), a memory 1002, and a communication bus 1003. The communication bus 1003 is configured to implement communication between the components in the terminal. The memory 1002 can be a high-speed random access memory (RAM) or a non-volatile memory, such as a magnetic disk memory. The memory 1002 can also be a storage device independent of the foregoing processor 1001.

Those skilled in the art can understand that the terminal structure shown in FIG. 1 does not constitute a limitation on the terminal of the embodiments of the present disclosure, and can include more or fewer components, a combination of some components, or differently arranged components than shown in the figure.

Figure 11:
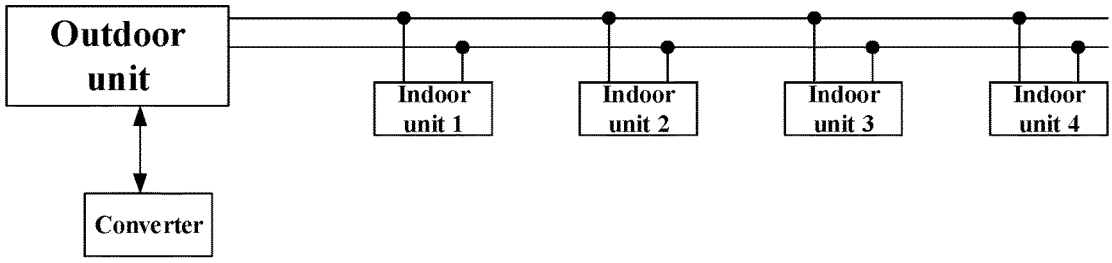
FIG. 11 is a schematic structural diagram of an air conditioner system of the control method according to an embodiment of the present disclosure.
Figure 12:
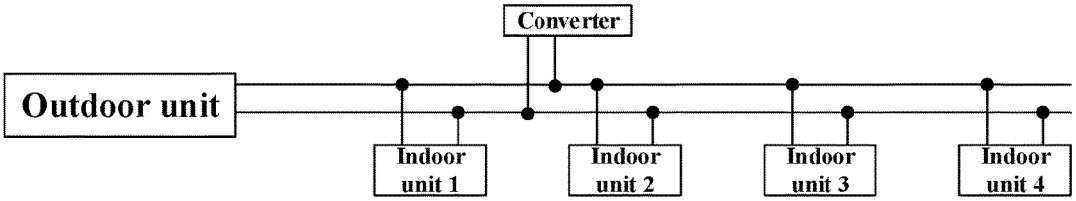
FIG. 12 is a schematic structural diagram of the air conditioner system of the control method according to another embodiment of the present disclosure.

The terminal of the embodiments of the present disclosure can be an air conditioner system. As shown in FIG. 11 to FIG. 12, the air conditioner system includes one outdoor unit, and at least two indoor units. Optionally, the air conditioner system has at least one indoor unit including a display screen, and the display screen can display a control interface. Optionally, the air conditioner system includes a data converter. The data converter communicates with the outdoor unit and multiple indoor units. The data converter communicates with an external device, receives a control instruction sent by the external device, and controls the outdoor unit and/or the multiple indoor units to operate according to the control instruction.

Specially, the outdoor unit communicates with the multiple indoor units. The data converter communicates with the outdoor unit and the multiple indoor units. The data converter is in communication connection with an external device, and the external device is connected to the air conditioner system with one outdoor unit and the multiple indoor units through the data converter. When the data converter receives a control instruction sent by the external device, the data converter controls the outdoor unit and/or the indoor units to operate according to the control instruction.

Optionally, the data converter communicates with the outdoor unit and the multiple indoor units through a serial communication bus. In this embodiment, the outdoor unit communicates with multiple indoor units through the serial communication bus. The outdoor unit and the multiple indoor units are connected together through a serial communication bus, so that the outdoor unit is in communication with the multiple indoor units. The data converter communicates with the serial communication bus, such that when receiving a control instruction sent by the external device, the data converter directly controls the outdoor unit and/or the indoor units according to the control instruction. In this embodiment, since the data converter communicates with the outdoor unit and the indoor units through a serial communication bus, the placement position of the data converter becomes flexible, which reduces the restriction on the installation position of the data converter, and facilitates the installation of the data converter.

Optionally, the electric control device in the outdoor unit includes an access recognition module and an identity switching module. The access recognition module recognizes the access of the data converter when the data converter is in communication with the outdoor unit and the multiple indoor units. The identity switching module switches the host identity of the outdoor unit to the extension identity when the access recognition module recognizes the access of the data converter, such that the data converter becomes the host identity, and controls the operation of the outdoor unit and/or the multiple indoor units. When the converter is not in communication with the outdoor unit and the multiple indoor units through the serial communication bus, the outdoor unit controls the multiple indoor units as a host. In this embodiment, the access recognition module is configured to identify whether the data converter is in communication with the outdoor unit and the multiple indoor units through the serial communication bus. When the data converter is in communication with the outdoor unit and the multiple indoor units through the serial communication bus, the access recognition module recognizes the access of the data converter. When the access recognition module recognizes the access of the data converter, the identity switching module switches the host identity of the outdoor unit to the extension identity, such that the data converter becomes the host identity and continues to control the outdoor unit and/or the multiple indoor units.

Optionally, the data converter includes an identity conversion module. When the data converter is in communication with the outdoor unit and the multiple indoor units, the data converter replaces the outdoor unit as the host identity, and controls the operation of the outdoor unit and/or the multiple indoor units. In this embodiment, when the data converter communicates with the outdoor unit and the multiple indoor units through a serial communication bus, the data converter communicates with the outdoor unit as an extension unit. When the outdoor unit recognizes that there is a communication between the data converter and the outdoor unit and the multiple indoor units through the serial communication bus, the host identity of the outdoor unit is switched to the extension identity, and then the state transition signal is sent to the data converter. When the data converter receives the state transition signal, the data converter converts the extension identity into the host identity, such that the data converter directly controls the outdoor unit and/or the multiple indoor units.

Specially, the data converter obtains the operation parameters of the multiple indoor units in real time or regularly, so as to control the operation of the outdoor unit and/or the multiple indoor units. In this embodiment, the data converter obtains the operation parameters of the multiple indoor units in real time or regularly, and the operation parameters include air speed, air supply temperature, air supply angle, or the like. When receiving several operation parameters of the multiple indoor units, the data converter sends the operation parameters to an external device, which is convenient for the external device to control the operation of the outdoor unit and/or the multiple indoor units through the data converter.

As such, the communication between the air conditioner system and external device is realized.

In an embodiment, each indoor unit is in the same local area network, therefore, the multiple indoor units of the control device or the air conditioner system can send historical operation records to the corresponding target indoor unit. When the number of indoor units of the air conditioner system is large, the area covered by the local area network configured for each indoor unit is larger, and more routers need to be arranged, which makes the control cost of the air conditioner system higher.

In this embodiment, the data converter receives the historical operation records sent by the control device or the air conditioner system, and then converts the format of the historical operation records, such that the outdoor unit can recognize the historical operation records in this format, and then the historical operation records are sent to the corresponding target indoor unit through the outdoor unit, there is no need to configure the corresponding local area network for each indoor unit, thereby saving the control cost of the air conditioner system. It should be noted that the data converter is equipped with a WIFI module, and the data converter is located in a room with a network, and is connected to the network through the WIFI module, and then receives historical operation records sent by the control device or the air conditioner system. It should be noted that before sending historical operation records to the data converter, it is needed to establish a communication between the control device and the data converter, or establish a communication between the air conditioner system and the data converter, the data converter and the control device need to be paired in advance to establish a communication between the two.

The terminal according to an embodiment of the present disclosure can also be a control device with a touch display unit, such as a smart phone, a tablet, a remote control of an air conditioner system with a display, or the like. The terminal of the embodiment can also be a server or a control terminal. It should be noted that the terminal can display the control interface on the display screen of the terminal, or display the control interface on a display device associated with the terminal. For example, when the air conditioner system is the terminal of the embodiment, the control interface can be displayed on the display screen of at least one indoor unit of the air conditioner system, or the control interface can be displayed on the smart phone associated with the air conditioner system. In the following description, the terminal of the embodiment is a control device with a touch display unit as an example.

As shown in FIG. 1, the memory 1002, which is a computer storage medium, can include a control program.

In the terminal shown in FIG. 1, the processor 1001 can call the control program stored in the memory 1002 and perform the following operations:

obtaining historical operation records for the at least two indoor units; and determining control parameters of at least two indoor units according to the historical operation records, to control the at least two indoor units.

Optionally, the processor 1001 can call the control program stored in the memory 1002 and perform the following operations:

respectively generating a first control set of each indoor unit according to the historical operation records, the first control set including at least two control functions, and control parameters corresponding to the at least two control functions; and controlling the at least two indoor units to operate with the corresponding control parameters in the first control set.

Optionally, the processor 1001 can call the control program stored in the memory 1002 and perform the following operations:

generating a second control set according to the historical operation records, the second control set being associated with the at least two indoor units and control parameters corresponding to the at least two indoor units; and controlling the at least two indoor units to operate with the corresponding control parameters in the second control set.

Optionally, the processor 1001 can call the control program stored in the memory 1002 and perform the following operations:

respectively generating a first control set of each indoor unit according to the historical operation records, the first control set including at least one control function, and control parameters corresponding to the at least one control function; and obtaining the first control sets of the at least two indoor units that are controlled simultaneously, to generate the second control set.

Optionally, the processor 1001 can call the control program stored in the memory 1002 and perform the following operations:

providing a selection interface for selecting multiple indoor units; and using indoor units selected in the selection interface as the indoor units to be controlled simultaneously in response to receiving a confirmation instruction.

Optionally, the processor 1001 can call the control program stored in the memory 1002 and perform the following operations:

the historical operation records include at least one of control times of the control parameters, control durations of the control parameters, control periods of the control parameters, or control environment information of the control parameters, wherein the control environment information includes at least one of environment temperature, environment humidity, or PM2.5 value.

Optionally, the processor 1001 can call the control program stored in the memory 1002 and perform the following operations:

when the control times of the control parameters corresponding to at least two control functions are greater than a preset threshold, and/or the control durations of the control parameters corresponding to the control functions are greater than a preset duration, generating the first control set, and adding control parameters corresponding to at least two control functions to the first control set.

Optionally, the processor 1001 can call the control program stored in the memory 1002 and perform the following operations:

selecting control parameters of at least two different control functions to generate the first control set according to the control times or the control durations of all the control parameters of the at least two indoor units, wherein the selected control parameter has a largest number of control times or a longest control duration among the control parameters in the corresponding control function.

Optionally, the processor 1001 can call the control program stored in the memory 1002 and perform the following operations:

selecting control parameters of at least one control function to generate the first control set according to the control times or the control durations of all the control parameters of the at least two indoor units, wherein the selected control parameter has a largest number of control times or a longest control duration among the control parameters in the corresponding control function.

Optionally, the processor 1001 can call the control program stored in the memory 1002 and perform the following operations:

when counting the control times of the control parameters, taking control times at different control environment information among the control times of the same control parameter as different control times.

Optionally, the processor 1001 can call the control program stored in the memory 1002 and perform the following operations:

obtaining a current time; and when control periods of control parameters corresponding to at least two control functions in the indoor unit correspond to the current time, generating the first control set, and adding control parameters corresponding to the at least two control functions to the first control set.

Optionally, the processor 1001 can call the control program stored in the memory 1002 and perform the following operations:

obtaining a current time; and generating the first control set according to the control period of the control parameters corresponding to the at least one control function within which the current time is located, and adding control parameters corresponding to the control period to the first control set.

Optionally, the processor 1001 can call the control program stored in the memory 1002 and perform the following operations:

generating a control button corresponding to the control parameters in the first control set on the control interface of the air conditioner system, the control button being associated with an indoor unit corresponding to the first control set;

in response to detecting that the control button on the control interface is triggered, obtaining the control parameters corresponding to the control button; and controlling the indoor unit associated with the control button to operate with the control parameters.

Optionally, the processor 1001 can call the control program stored in the memory 1002 and perform the following operations:

in response to generation of the first control set, generating a prompt message about whether to generate the control button corresponding to the first control set; and in response to receiving a confirmation for generating the control button corresponding to the first control set, generating the control button on the control interface.

Optionally, the processor 1001 can call the control program stored in the memory 1002 and perform the following operations:

generating a control button corresponding to the control parameters in the second control set on the control interface of the air conditioner system, the control button being associated with at least two indoor units corresponding to the second control set;

in response to detecting that the control button on the control interface is triggered, obtaining the control parameters corresponding to the control button; and controlling each indoor unit associated with the control button to operate with the corresponding control parameters.

Optionally, the processor 1001 can call the control program stored in the memory 1002 and perform the following operations:

in response to generation of the second control set, generating a prompt message about whether to generate the control button corresponding to the second control set; and in response to receiving a confirmation for generating the control button corresponding to the second control set, generating the control button on the control interface.

Optionally, the processor 1001 can call the control program stored in the memory 1002 and perform the following operations:

in response to an adjustment operation for control parameters of an indoor unit, updating associated control parameters in the first control set according to the adjusted control parameters.

Optionally, the processor 1001 can call the control program stored in the memory 1002 and perform the following operations:

in response to an adjustment operation for control parameters of an indoor unit, updating control parameters corresponding to the indoor unit in the second control set according to the adjusted control parameters.

Optionally, the processor 1001 can call the control program stored in the memory 1002 and perform the following operations:

in response to receiving an editing instruction of the control button, generating an editing interface according to an indoor unit identification of the indoor unit corresponding to the control button and the control parameters; and in response to receiving a response instruction to confirm editing, updating the control button, and saving a corresponding edited relationship between the indoor unit identification, the control parameters and the control button.

Optionally, the processor 1001 can call the control program stored in the memory 1002 and perform the following operations:

the editing interface provides options of associating the indoor units and the control button, when a selection operation of an option is detected, an indoor unit identification of an indoor unit corresponding to the option is used as the edited indoor unit identification.

Optionally, the processor 1001 can call the control program stored in the memory 1002 and perform the following operations:

the editing interface provides setting options for the control parameters of the indoor units, and in response to detecting an adjustment operation for the control parameters triggered based on the setting options, the adjusted control parameters are used as the edited control parameters.

Figure 2:
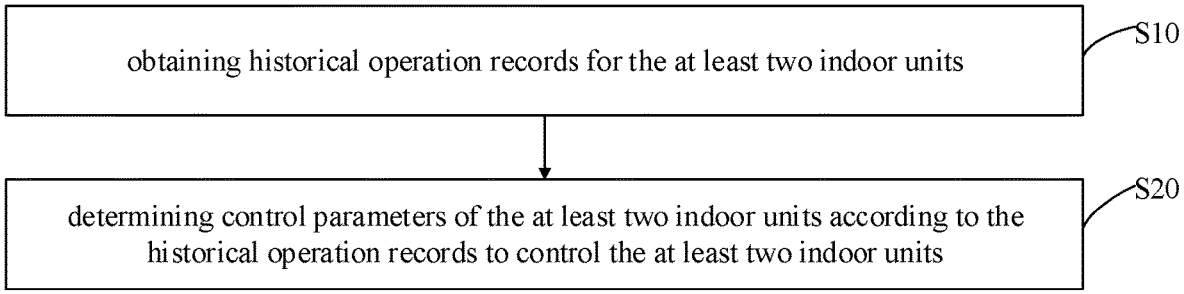
FIG. 2 is a schematic flowchart of a control method according to a first embodiment of the present disclosure.

As shown in FIG. 2, in an embodiment, the control method includes:

Operation S10, obtaining historical operation records for the at least two indoor units.

In this embodiment, the terminal of the embodiment is a control device with a touch display unit, such as a smart phone, a tablet, a remote control of an air conditioner system with a touch display, and the like.

Optionally, the air conditioner system has a centralized control parameter setting interface, in which the user can set the control parameters of at least one indoor unit (the control parameters of multiple indoor units can be set simultaneously).

Optionally, each indoor unit of the air conditioner system has a corresponding operation interface. The operation interface of each indoor unit includes all the control buttons for the indoor unit, and the user can set all the control parameters of a certain indoor unit on the operation interface of the indoor unit.

The indoor unit can operate according to the preset control parameters and the changed control parameters set by the user. When the indoor unit is operating, the terminal can separately record and control the historical operation records of each indoor unit.

The historical operation records include at least one of control times of the control parameters, control durations of the control parameters, control periods of the control parameters, or control environment information of the control parameters, wherein the control environment information includes at least one of environment temperature, environment humidity, or PM2.5 value.

Optionally, the terminal can first divide a preset duration into multiple control periods, and associate the control parameters with the control period in which the operation time point is located according to the time point when the indoor unit is operating with each control parameter. The preset duration can be one day, one month, one year, or the like. For example, the control period can be a certain period of the day, such as 18:30-22:30, and the control period can also be a certain month or seasonal period of the year, such as June to September.

Optionally, when the indoor unit is operating with a certain control parameter, the terminal can record the control environment information corresponding to the control parameter of the indoor unit. That is, when the indoor unit is operating with the control parameter, the current indoor unit detects the environment temperature, environment humidity, and PM2.5 value. The environment temperature can be the indoor temperature or the outdoor temperature; the environment humidity is the indoor relative humidity.

Optionally, when the user sets the indoor unit to operate with a certain control parameter, the terminal can record the control times of the control parameter and count the control times of the indoor unit operating with the same control parameter. For example, it is recorded that the control times when the indoor unit is operating to control a temperature to be 23° C. are 60 times, the control times when the indoor unit is operating to control the temperature to be 26° C. are 210 times, the control times when the indoor unit is operating at 50% air speed is 20 times, the control times when the indoor unit is operating at 30% air speed are 64 times, and the control times when the indoor unit is shut down after 9 hours are 110 times.

Optionally, the terminal can also record the control times of different control periods operating with the same control parameter. Optionally, the terminal can also record the control times of different control environment information operating with the same control parameter. For example, the terminal can count that when the indoor unit is operating to maintain a temperature to be 23° C., the control times when the outdoor temperature is 27-30° C. are 40 times, and the control times when the outdoor temperature is 31-35° C. are 80 times.

Optionally, the terminal can separately record the control durations of the indoor unit operating with different control parameters, and make statistics on the control durations of the indoor unit operating with the same control parameter. For example, it is recorded that the control durations when the indoor unit is operating at temperature control 23° C. are 60 hours, the control durations when the indoor unit is operating at temperature control 26° C. are 210 hours, the control durations when the indoor unit is operating at 50% air speed is 20 hours, and the control durations when the indoor unit is operating at 30% air speed are 64 hours.

Optionally, the terminal can also record the control durations of different control periods operating with the same control parameter. Optionally, the terminal can also record the control durations of different control environment information operating with the same control parameter. For example, the terminal can count that when the indoor unit is operating at temperature control 26° C., the control durations when the outdoor temperature is 27-30° C. are 250 hours, and the control durations when the outdoor temperature is 31-35° C. are 600 hours.

Operation S20, determining control parameters of the at least two indoor units according to the historical operation records to control the at least two indoor units.

Optionally, the terminal can respectively generate a first control set of each indoor unit according to the historical operation records, the first control set including at least two control functions, and control parameters corresponding to the at least two control functions, and controls the at least two indoor units to operate with the corresponding control parameters in the first control set.

Optionally, the terminal can generate a second control set according to the historical operation records, the second control set being associated with the at least two indoor units and control parameters corresponding to the at least two indoor units, and controls the at least two indoor units to operate with the corresponding control parameters in the second control set. Optionally, a first control set of each indoor unit is generated according to the historical operation records, the first control set includes at least one control function and control parameters corresponding to the at least one control function, and the first control sets of the at least two indoor units that are controlled simultaneously is obtained to generate the second control set.

It should be noted that each control parameter of the indoor unit has its corresponding control function. For example, the temperature control of 24° C. and the temperature control of 15° C. both correspond to the temperature control function of the indoor unit, and the air speed of 20% or the air speed of third gear corresponds to the air speed control function of the indoor unit.

When the terminal generates a first control set including at least two control functions of the indoor unit and control parameters corresponding to the at least two control functions according to the historical operation records, optionally, when the control times of the control parameters corresponding to at least two control functions are greater than a preset threshold, and/or the control durations of the control parameters corresponding to the control functions are greater than a preset duration, the first control set is generated, and the control parameters corresponding to the control function are added to the first control set. Optionally, in the same control function, when the control times of more than two control parameters are greater than the preset threshold, and/or the control durations are greater than the preset duration, the control parameter with the most control times or the longest control durations is selected and added to the first control set among the control parameters of the control function. It should be noted that the preset threshold can be 3 times, 5 times, 10 times, 20 times, or the like, and optionally can be 10 times. The preset duration can be 20 hours, 40 hours, 50 hours, 60 hours, or the like, and optionally can be 50 hours.

When the terminal generates a first control set including at least two control functions of the indoor unit and control parameters corresponding to the at least two control functions according to the historical operation records, optionally, the terminal can sort the control times or control durations of all the control parameters of the indoor unit, and the terminal can obtain the top preset number of control parameters in the sorting result and add the control parameters to the first control set. In the same control function, when the control times or control durations of more than two control parameters are in the top preset number of the sorting result, the control parameter with the most control times or the longest control durations is selected and added to the first control set among the control parameters of the control function. The preset number value is greater than or equal to two.

When the terminal generates a first control set including at least one control function of the indoor unit and control parameters corresponding to the at least one control function according to the historical operation records, optionally, the terminal can sort the control times or control durations of all the control parameters of the indoor unit, and the terminal can obtain the top preset number of control parameters in the sorting result and add the control parameters to the first control set. In the same control function, when the control times or control durations of more than two control parameters are in the top preset number of the sorting result, the control parameter with the most control times or the longest control durations is selected and added to the first control set among the control parameters of the control function. The preset number value is greater than or equal to one, so that it can be realized that the first control set has at least one control parameter corresponding to one control function of the indoor unit.

The terminal can generate a first control set including at least two control functions and control parameters corresponding to the at least two control functions, or generate a first control set including at least one control function and control parameters corresponding to the at least one control function for each indoor unit.

When detecting that at least two indoor units are controlled (or the at least two indoor units are turned on), the terminal can control the two indoor units to operate with the control parameters in the corresponding first control set.

When detecting a response operation of the first control set of the indoor unit, the terminal can control the indoor unit to operate with the corresponding first control set.

The terminal can obtain the first control set of at least two indoor units to generate the second control set. The second control set includes control parameters in the first control set. These control parameters respectively correspond to the indoor units of the first control set, and the indoor units corresponding to the first control set are associated with the second control set. When detecting the response operation of the second control set, the terminal controls the indoor units associated with the second control set to operate with the corresponding control parameters in the second control set.

It should be noted that when the terminal is an external device that controls the air conditioner system, the terminal can generate a control instruction according to the control parameters in the first control set and the indoor unit information of the indoor unit corresponding to the first control set, and send the control instruction to the air conditioner system. After receiving the control instruction, the controller can obtain the indoor unit information and control parameters according to the control instruction, and control the indoor unit corresponding to the indoor unit information to operate with the control parameters. Alternatively, the terminal can generate a control instruction according to the control parameters in the first control set, and send the control instruction to the indoor unit corresponding to the first control set. After receiving the control instruction, the indoor unit operates with the control parameters corresponding to the control instruction.

It should be noted that when the terminal is an external device that controls the air conditioner system, the terminal can generate a control instruction according to the control parameters in the second control set and the indoor unit information of the indoor unit corresponding to the second control set, and send the control instruction to the air conditioner system. After receiving the control instruction, the controller can obtain the indoor unit information and control parameters according to the control instruction, and control the indoor unit corresponding to the indoor unit information to operate with the control parameters. Alternatively, the terminal can generate a control instruction according to the control parameters in the second control set, and send the control instruction to the indoor unit corresponding to the second control set. After receiving the control instruction, the indoor unit operates with the control parameters corresponding to the control instruction.

In an embodiment, historical operation records for the at least two indoor units are obtained, and control parameters of the at least two indoor units are determined according to the historical operation records to control the at least two indoor units. As such, the user's setting information/habits of the control parameters of the indoor units of the air conditioner system are recorded every time. After the user performs control operations of the indoor units many times, the same control parameters of multiple same indoor units frequently used by the user are set as a shortcut, which is convenient for the user to control the air conditioner system with multiple indoor units.

Figure 3:
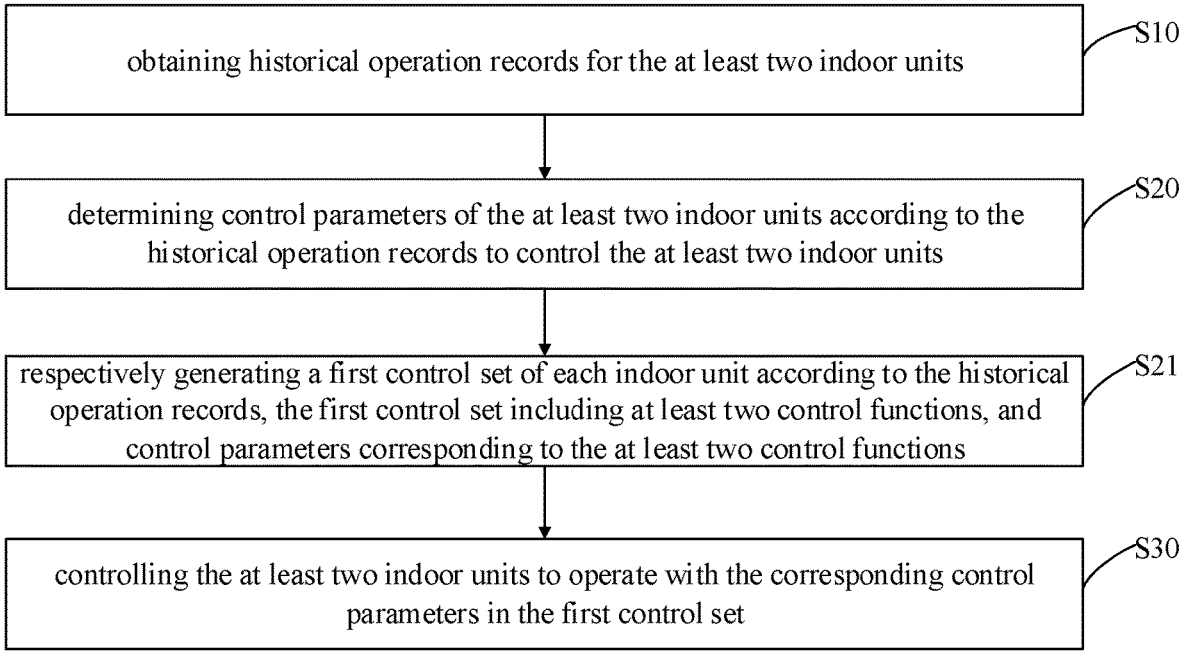
FIG. 3 is a schematic flowchart of the control method according to a second embodiment of the present disclosure.

In a second embodiment, as shown in FIG. 3, based on the embodiment shown in FIG. 2, the control method further includes:

Operation S21, respectively generating a first control set of each indoor unit according to the historical operation records, the first control set including at least two control functions, and control parameters corresponding to the at least two control functions.

Operation S30, controlling the at least two indoor units to operate with the corresponding control parameters in the first control set.

In this embodiment, the terminal can respectively generate a first control set of each indoor unit according to the historical operation records, the first control set including at least two control functions, and control parameters corresponding to the at least two control functions, and control the at least two indoor units to operate with the corresponding control parameters in the first control set.

Optionally, the terminal can generate the first control set of each indoor unit according to the control period of the control parameter. The terminal can first divide a preset duration into multiple control periods, and associate the control parameters with the control period in which the operation time point is located according to the time point when the indoor unit is operating with each control parameter. The preset duration can be one day, one month, one year, or the like. For example, the control period can be a certain period of the day, such as 18:30-22:30, and the control period can also be a certain month or a seasonal period of the year, such as June to September.

The terminal can obtain the current time in real time, and search for the pre-divided control period according to the current time, and find the control period in which the current time is located. Since the control parameter has been associated with the control period when recording the control period of the control parameter, the control parameter associated with the control period can be obtained after the control period is determined according to the current time.

The terminal can select control parameters corresponding to at least two different control functions from the control parameters associated with the operating period, and add the control parameters to the first control set of the indoor unit. Optionally, the terminal can select the control parameter with the largest number of recorded control times or the longest control duration among these control parameters, and also select a control parameter whose number of control times is greater than a preset threshold and/or whose control duration is greater than a preset duration among these control parameters. The preset threshold can be 3 times, 5 times, 10 times, 20 times, or the like, and optionally can be 10 times. The preset duration can be 20 hours, 40 hours, 50 hours, 60 hours, or the like, and optionally can be 50 hours.

When detecting that at least two indoor units are controlled (or the at least two indoor units are turned on), the terminal can control the two indoor units to operate with the control parameters in the corresponding first control set.

When detecting a response operation of the first control set of the indoor unit, the terminal can control the indoor unit to operate with the corresponding first control set.

As such, the control parameters in the first control set used to quickly control the indoor unit can be changed according to the change in the use period of the indoor unit. For example, in general, the air speed function of the air conditioner is the most frequently used by users. However, due to the weather caused by seasonal changes (summer to winter), the user may not need to adjust the air speed frequently, and the sleep function is used more frequently. After the terminal counts the trigger frequency of the control button through the data, it is found that the control parameters corresponding to the sleep function are controlled more often than the temperature control parameters, such that the air speed control parameter in the first control set of the indoor unit is adjusted to the control parameter corresponding to the sleep function.

Figure 4:
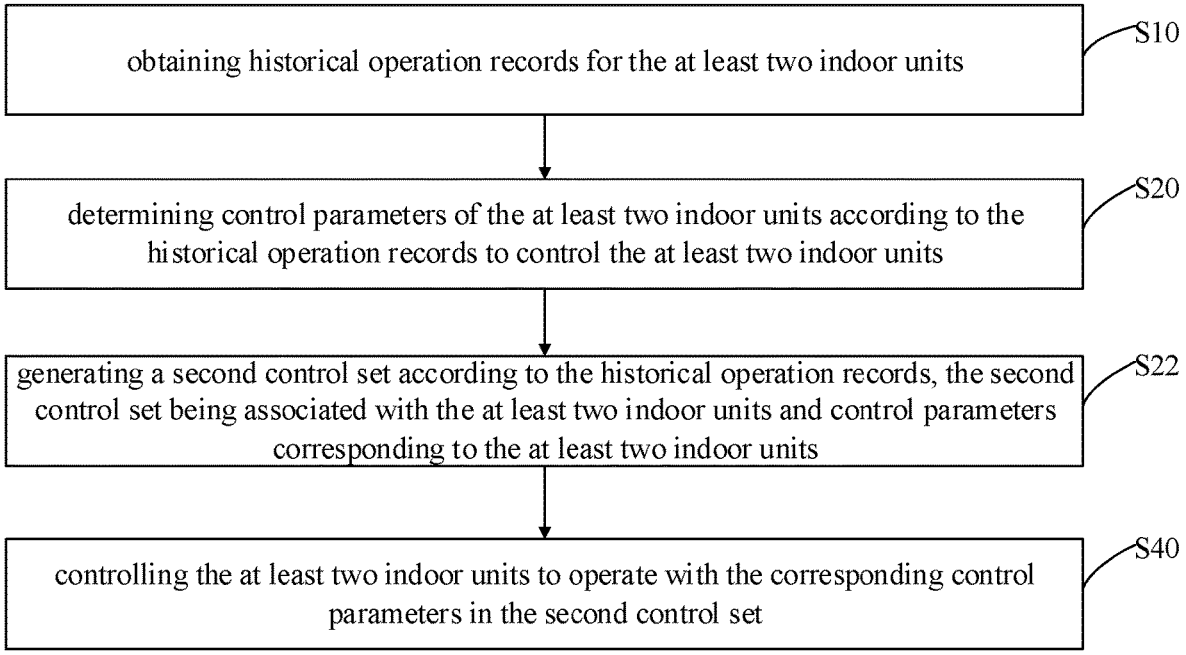
FIG. 4 is a schematic flowchart of the control method according to a third embodiment of the present disclosure.

In a third embodiment, as shown in FIG. 4, based on the embodiments shown in FIG. 2 to FIG. 3, the operation of when detecting that the control button on the control interface is triggered, adjusting the control parameter corresponding to the control button according to the control parameter adjustment operation generated based on the control button includes:

Operation S22, generating a second control set according to the historical operation records, the second control set being associated with the at least two indoor units and control parameters corresponding to the at least two indoor units.

Operation S40, controlling the at least two indoor units to operate with the corresponding control parameters in the second control set.

In this embodiment, the terminal can generate a second control set according to the historical operation records, the second control set being associated with the at least two indoor units and control parameters corresponding to the at least two indoor units, and control the at least two indoor units to operate with the corresponding control parameters in the second control set. Optionally, a first control set of each indoor unit is generated according to the historical operation records, the first control set includes at least one control function, and control parameters corresponding to the at least one control function, and the first control sets of the at least two indoor units that are controlled simultaneously is obtained to generate the second control set.

Optionally, the terminal can generate the first control set of each indoor unit according to the control period of the control parameter. The terminal can first divide a preset duration into multiple control periods, and associate the control parameters with the control period in which the operation time point is located according to the time point when the indoor unit is operating with each control parameter. The preset duration can be one day, one month, one year, or the like. For example, the control period can be a certain period of the day, such as 18:30-22:30, and the control period can also be a certain month or seasonal period of the year, such as June to September.

The terminal can obtain the current time in real time, and search for the pre-divided control period according to the current time, and find the control period in which the current time is located. Since the control parameter has been associated with the control period when recording the control period of the control parameter, the control parameter associated with the control period can be obtained after the control period is determined according to the current time.

The terminal can select control parameters corresponding to at least one control function from the control parameters associated with the operating period and add the control parameters to the first control set of the indoor unit. Optionally, the terminal can select a control parameter with the largest number of recorded control times or the longest control duration among these control parameters, and also select a control parameter whose number of control times is greater than a preset threshold and/or whose control duration is greater than a preset duration among these control parameters. The preset threshold can be 3 times, 5 times, 10 times, 20 times, or the like, and optionally can be 10 times. The preset duration can be 20 hours, 40 hours, 50 hours, 60 hours, or the like, and optionally can be 50 hours.

As such, a first control set in which each indoor unit has at least one control function and control parameters corresponding to the at least one control function can be generated. When the terminal detects that there are indoor units that are controlled simultaneously (that is, at least two indoor units are controlled simultaneously), the terminal can obtain the first control set of these indoor units to generate the second control set. The second control set includes control parameters in the first control set. These control parameters respectively correspond to the indoor units of the first control set where they are originally located, and the indoor units corresponding to these first control sets are associated with the second control set. When detecting the response operation of the second control set, the terminal controls the indoor units associated with the second control set to operate with the corresponding control parameters in the second control set, so that rapid control of multiple indoor units can be realized.

Figure 5:
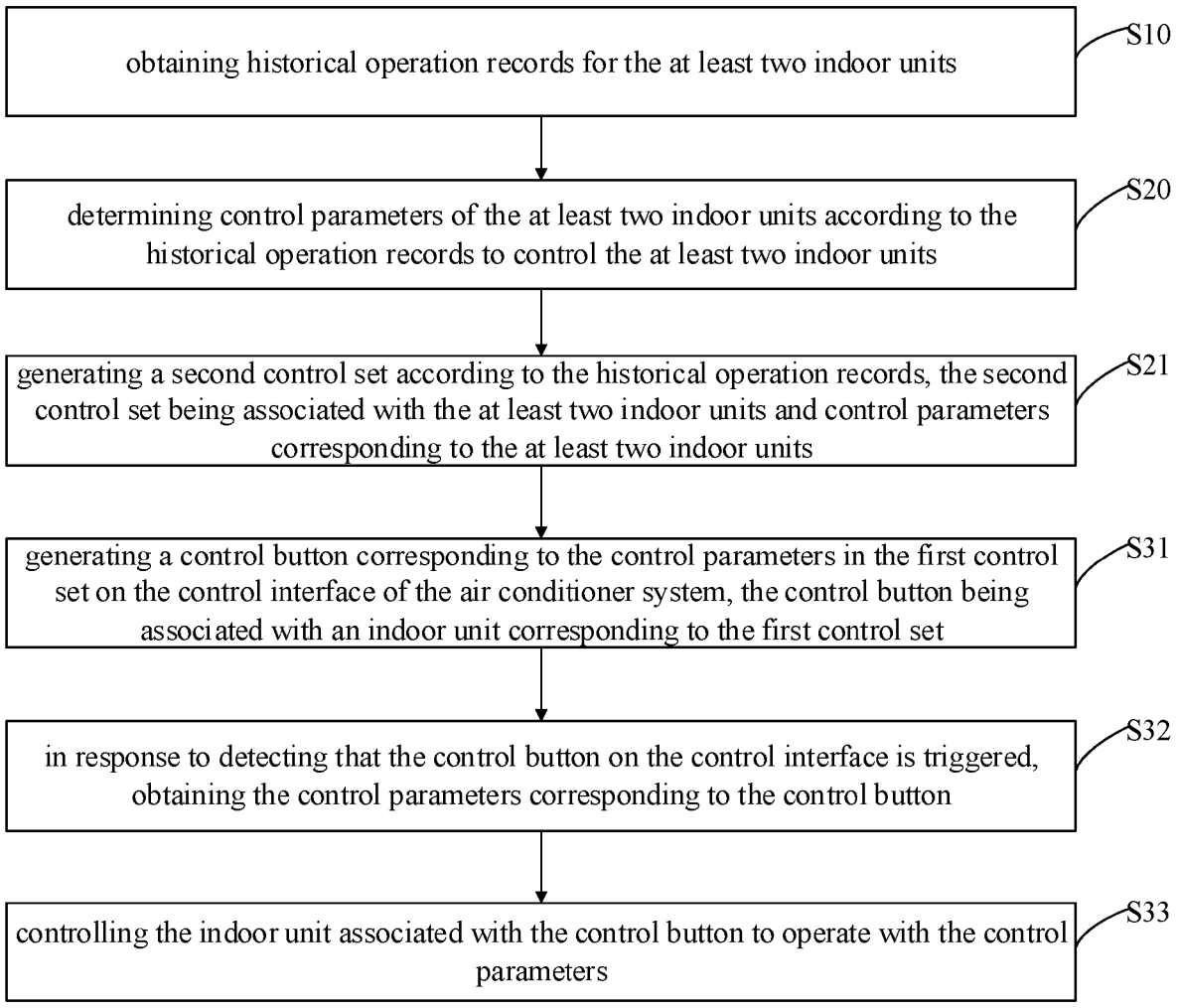
FIG. 5 is a schematic flowchart of the control method according to a fourth embodiment of the present disclosure.

In a fourth embodiment, as shown in FIG. 5, based on the embodiments shown in FIG. 2 to FIG. 4, the operation of controlling the at least two indoor units to operate with the corresponding control parameters in the first control set includes:

Operation S31, generating a control button corresponding to the control parameters in the first control set on the control interface of the air conditioner system, the control button being associated with an indoor unit corresponding to the first control set;

Operation S32, in response to detecting that the control button on the control interface is triggered, obtaining the control parameters corresponding to the control button; and Operation S33, controlling the indoor unit associated with the control button to operate with the control parameters.

In this embodiment, the terminal can generate a first control set of each indoor unit according to the historical operation records, the first control set including at least two control functions and control parameters corresponding to the at least two control functions, and control the at least two indoor units to operate with the corresponding control parameters in the first control set.

Optionally, the terminal can control the indoor unit to operate with the corresponding first control set when detecting a response operation of the first control set of the indoor unit.

Each control button of the indoor unit can be a button that controls the operation of a specific function of the indoor unit, such as air speed, humidification, purification, temperature, or the like. When the user sets the control parameters of a certain function of the indoor unit on the control button of a certain indoor unit (when the indoor unit function corresponding to the control button is "air speed," the control parameter can be "air speed of 50%" or "air speed of third gear," or the like), the terminal can record the setting times of the control parameter.

Figure 7:
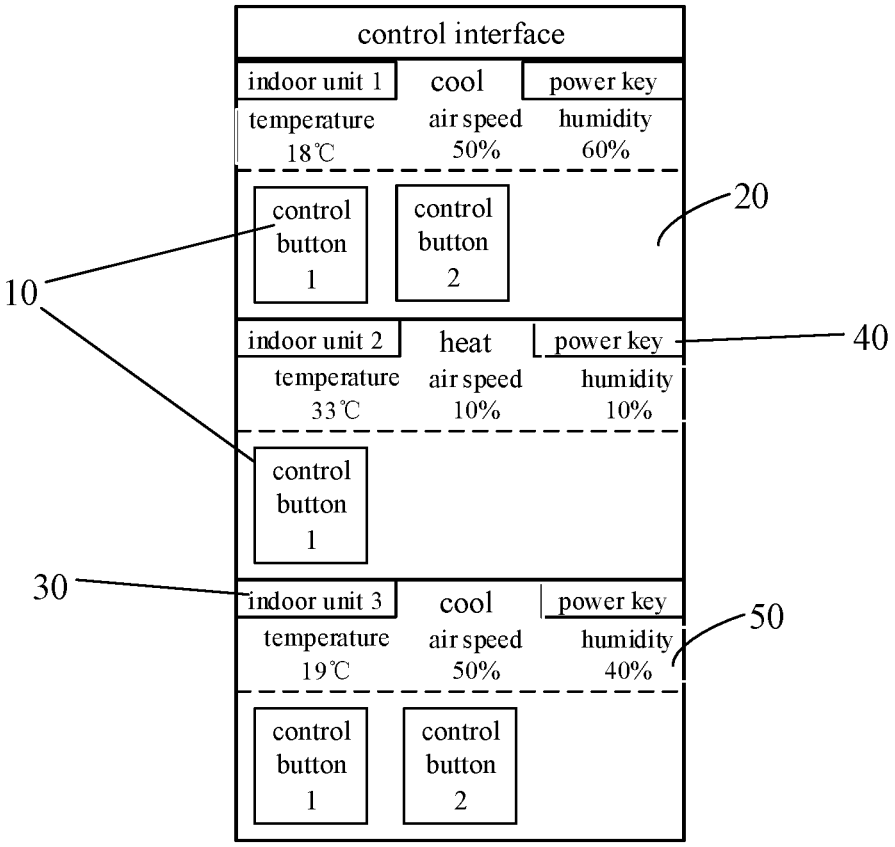
FIG. 7 is a schematic diagram of a control interface of the control method according to an embodiment of the present disclosure.

Optionally, as shown in FIG. 7, the air conditioner system has a control interface. The control interface can include the control button display area 20 of each indoor unit. The control button 10 of each indoor unit on the control interface is displayed in the corresponding control button display area 20, and the control parameter corresponding to the control button 10 is associated with the indoor unit information of the indoor unit.

When the generation of the first control set of the indoor unit is detected, a control button corresponding to the control parameter in the first control set is generated on the control interface of the air conditioner system. The control button is associated with an indoor unit corresponding to the first control set.

Figure 8:
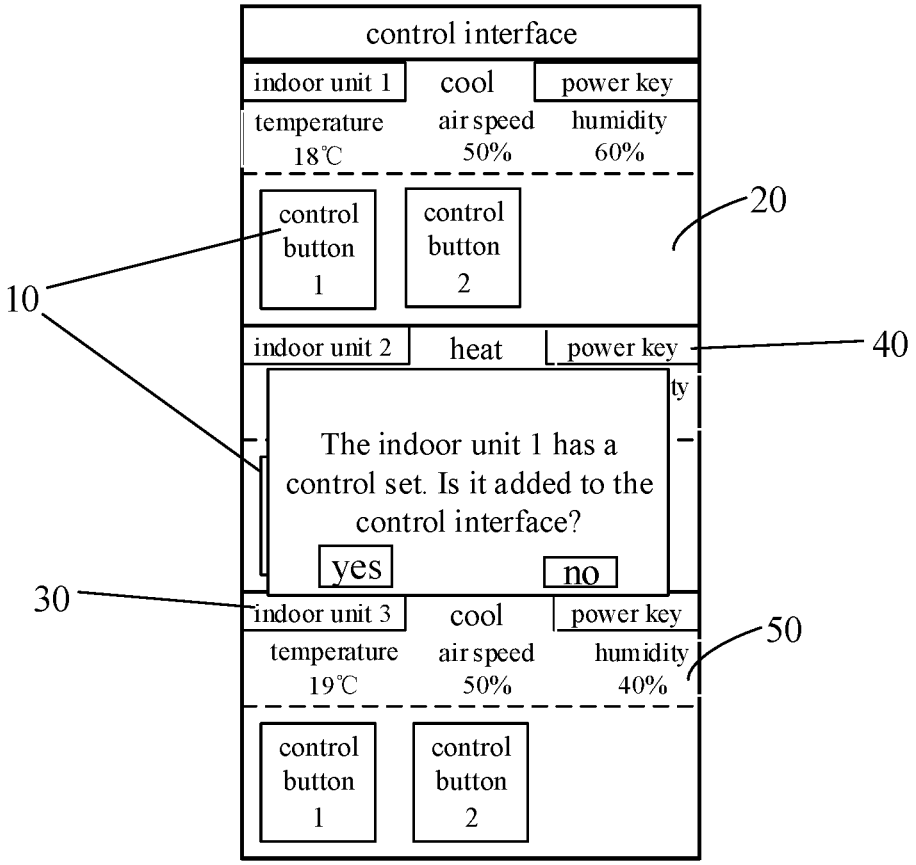
FIG. 8 is a schematic diagram of a control button generation prompt of the control method according to an embodiment of the present disclosure.

Optionally, as shown in FIG. 8, when the generation of the first control set of the indoor unit is detected, the terminal generates and displays the prompt information of whether to generate the control button corresponding to the first control set on the control interface. The control parameters in the first control set are generally the indoor unit control parameters commonly used by the user or the indoor unit control parameters that the user prefers to use. At this time, the user is prompted whether to save the control key generated according to the user's own control habit of the indoor unit to the control interface. When a response instruction based on the confirmation of the prompt information is received (for example, the user touches the "Yes" button of the prompt information to confirm the prompt information, and at this time, the terminal may generate a response instruction for the confirmation of the prompt information), the terminal generates the control buttons corresponding to the first control set on the control interface, and saves the indoor unit information corresponding to the indoor units in the first control set and the control parameters of the first control set to the newly generated control button on the control interface, associates the indoor unit information of the indoor unit with the control parameters of the indoor unit in the control set, and associates the indoor unit information of the indoor unit with the control buttons.

When the triggering of the control button on the control interface is detected (for example, the user presses the control button on the control interface, or the user clicks the control button on the control interface with the remote control or cursor), the indoor unit information corresponding to the control button currently triggered on the control interface (the indoor unit associated with the control button can be known through the indoor unit information), and the control parameters associated with the control button are obtained. For example, the indoor unit information corresponding to the control button currently triggered on the control interface can be "indoor unit 1," and the control parameter associated with the control button can be "temperature 25° C."

After obtaining the indoor unit information corresponding to the control button that is currently triggered on the control interface, the indoor unit associated with the control button can be determined. Simultaneously, the obtained control parameter corresponding to the control button can be used as the control parameter of the indoor unit, and the terminal can control the indoor unit to operate with the control parameter corresponding to the control button according to the indoor unit information.

Optionally, as shown in FIG. 7, in order to facilitate the user to understand the control parameter corresponding to the control button, the display position of the control button in the control button display area 50 of the indoor unit corresponding to the control interface can display the name of the control button and the associated control parameter.

Optionally, the control button of the indoor unit on the control interface is associated with the switch function of the indoor unit by default. When the control button is triggered on the control interface, the indoor unit is activated when the indoor unit information and control parameters corresponding to the control button are obtained. It should be understood that when the control button is triggered again on the control interface, the indoor unit is turned off. In this way, the control efficiency of the indoor unit can be improved.

Optionally, the terminal can generate multiple first control sets for each indoor unit, and control keys corresponding to the first control sets.

Optionally, in response to the adjustment operation for the control parameter of the indoor unit, the associated control parameter in the first control set is updated according to the adjusted control parameter. After the indoor unit operates with the corresponding control parameters in the first control set, if the user's adjustment operation on the control parameters of the indoor unit is detected again, such as adjusting the value of the control parameter, the control function corresponding to the control parameter of the current indoor unit operation and control parameter are changed, which shows that the control parameters in the first control set are not completely suitable for the user, and the control parameters in the first control set can be updated according to the user's current changes to the control parameters. Alternatively, when the user controls the indoor unit based on using the first control set multiple times, the control parameters are set on the basis of the control parameters in the first control set, and the control parameters in the first control set are updated according to the control parameters changed by the user.

As such, the user's setting information/habits of control parameters on the operation interface of an indoor unit are recorded every time. After the user performs multiple centralized control operations of the indoor unit, the same control parameters of the same indoor unit frequently used by the user are used as a shortcut. When the user starts the same operation of multiple same indoor units next time, there is no need to complete the centralized control function, just start the shortcut, which is convenient for the user to control the air conditioner system with multiple indoor units.

Figure 6:
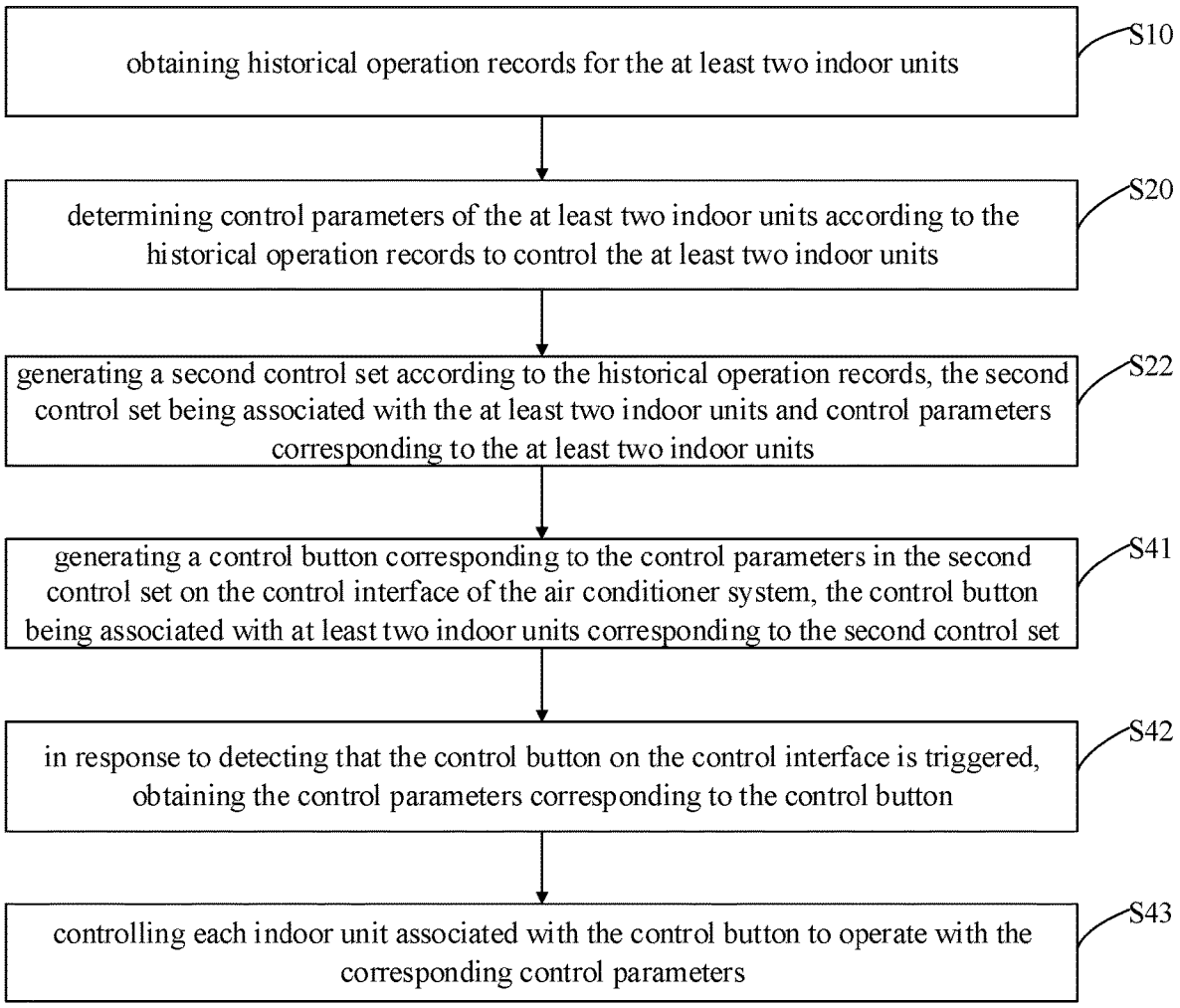
FIG. 6 is a schematic flowchart of the control method according to a fifth embodiment of the present disclosure.

In a fifth embodiment, as shown in FIG. 6, based on the embodiments shown in FIG. 2 to FIG. 5, the operation of controlling the at least two indoor units to operate with the corresponding control parameters in the second control set includes:

Operation S41, generating a control button corresponding to the control parameters in the second control set on the control interface of the air conditioner system, the control button being associated with at least two indoor units corresponding to the second control set.

Operation S42, in response to detecting that the control button on the control interface is triggered, obtaining the control parameters corresponding to the control button.

Operation S43, controlling each indoor unit associated with the control button to operate with the corresponding control parameters.

In this embodiment, the terminal can generate the second control set according to the historical operation records, the second control set being associated with at least two indoor units and control parameters corresponding to the at least two indoor units, and control the at least two indoor units to operate with the corresponding control parameters in the second control set. Optionally, a first control set of each indoor unit is generated according to the historical operation records, the first control set includes at least one control function, and control parameters corresponding to the at least one control function, and the first control sets of the at least two indoor units that are controlled simultaneously is obtained to generate the second control set.

Optionally, when the terminal detects that there are indoor units that are controlled simultaneously (that is, at least two indoor units are controlled simultaneously), the terminal can obtain the first control set of these indoor units to generate the second control set. The second control set includes control parameters in the first control set. These control parameters respectively correspond to the indoor units of the first control set where they are originally located, and the indoor units corresponding to these first control sets are associated with the second control set.

Figure 9:
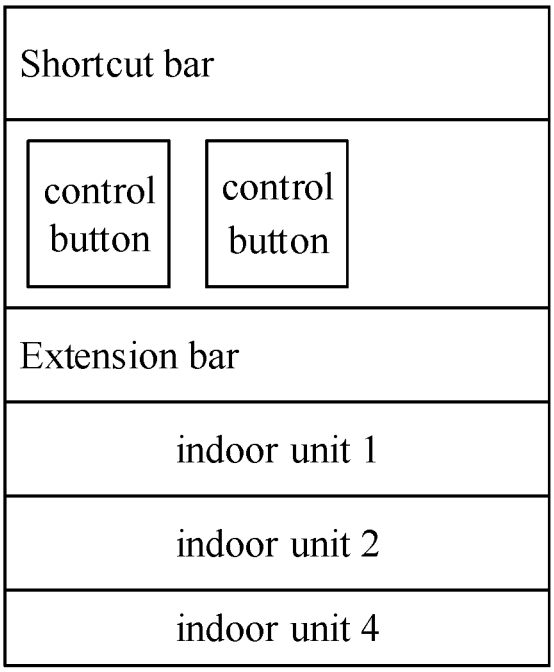
FIG. 9 is a schematic diagram of the control interface of the control method according to another embodiment of the present disclosure.

Optionally, the air conditioner system has a control interface, and the control interface of the air conditioner system is displayed on the display interface of the terminal. Optionally, as shown in FIG. 9, the control interface can include a shortcut bar, and the shortcut bar can display multiple control keys. At least one control button is currently displayed on the control interface. Each control button corresponds to at least two indoor unit information. Each indoor unit information has a corresponding indoor unit, that is, each indoor unit corresponds to different indoor unit information. The indoor unit information is used to indicate the indoor unit currently associated with the control button, that is, each control button is associated with at least two indoor units.

Optionally, when entering the control interface of the air conditioner system through the APP on the control device, the terminal can first query the indoor unit connection information under the air conditioner system, such as connection data, connection status, indoor unit model, or the like. These pieces of information are displayed on the APP with graphical interaction including the selection interface of all indoor units. In this selection interface, the user can configure each indoor unit, the configuration methods include activation and silence, and operable functions include: display, control, or the like. If the user configures an indoor unit to be silent, the control interface of the indoor unit will not be displayed in the subsequent control. If the user configures an indoor unit to be activated, the control interface of the indoor unit will be displayed in the subsequent control. When the user selects that at least two indoor units are currently active, these indoor units are the indoor units that are controlled simultaneously.

When the generation of the second control set of the indoor unit is detected, a control button corresponding to the control parameter in the second control set is generated on the control interface of the air conditioner system, and the control button is associated with an indoor unit corresponding to the second control set.

Figure 10:
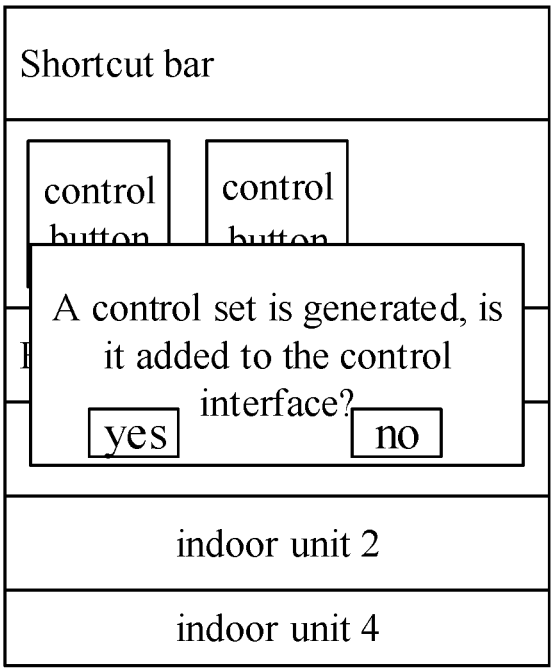
FIG. 10 is a schematic diagram of the control button generation prompt of the control method according to another embodiment of the present disclosure.

Optionally, as shown in FIG. 10, when the generation of the second control set of the indoor unit is detected, the terminal generates and displays the prompt information of whether to generate the control button corresponding to the second control set on the control interface. The control parameters in the second control set are generally the indoor unit control parameters commonly used by the user or the indoor unit control parameters that the user prefers to use. At this time, the user is prompted whether to save the control key generated according to the user's own control habit of the indoor unit to the control interface. When a response instruction based on the confirmation of the prompt information is received (for example, the user touches the "Yes" button of the prompt information to confirm the prompt information, and at this time, the terminal may generate a response instruction for the confirmation of the prompt information), the terminal generates the control buttons corresponding to the second control set on the control interface, and saves the indoor unit information corresponding to the indoor units in the second control set and the control parameters of the second control set to the newly generated control button on the control interface, associates the indoor unit information of the indoor unit with the control parameters of the indoor unit in the control set, and associates the indoor unit information of the indoor unit with the control buttons.

Optionally, the control parameters corresponding to the indoor unit information associated with the control buttons on the control interface can be the same or different. For example, the indoor unit information corresponding to the control button that is currently triggered on the control interface is "indoor unit 1" and "indoor unit 2," when the control parameters associated with the control button are "temperature 25° C." and "air speed 50%," indoor unit 1 and indoor unit 2 are controlled to perform cooling output of "temperature 25° C." and "air speed 50%." For example, the indoor unit information corresponding to the control button that is currently triggered on the control interface is "indoor unit 1" and "indoor unit 2," when the control parameter corresponding to "indoor unit 1" is "temperature 25° C.," and the control parameter corresponding to "indoor unit 2" is "air speed 50%," the indoor unit 1 is controlled to output cooling at "temperature 25° C.," and the indoor unit 2 is controlled to output cooling at "air speed 50%."

After obtaining the indoor unit information corresponding to the control button that is currently triggered on the control interface, the indoor unit associated with the control button can be determined. Simultaneously, the obtained control parameter corresponding to the control button can be used as the control parameter of the indoor unit, and the terminal can control the indoor unit to operate with the control parameter corresponding to the control button according to the indoor unit information.

Optionally, the terminal can generate multiple second control sets with different indoor unit combinations, and control keys corresponding to the second control sets.

Optionally, in response to the adjustment operation for the control parameters of the indoor unit, the associated control parameters in the second control set are updated according to the adjusted control parameter. After the indoor unit operates with the corresponding control parameters in the second control set, if the user's adjustment operation on the control parameters of the indoor unit is detected again, such as adjusting the value of the control parameter, the control function corresponding to the control parameter of the current indoor unit operation and control parameter are changed, which shows that the control parameters in the second control set are not completely suitable for the user, and the control parameters in the second control set can be updated according to the user's current changes to the control parameters. Alternatively, when the user controls the indoor unit based on using the second control set multiple times, the control parameters are set on the basis of the control parameters in the second control set, and the control parameters in the second control set are updated according to the control parameters changed by the user.

As such, the user's setting information/habits of control parameters on the operation interface of an indoor unit are recorded every time. After the user performs multiple centralized control operations of the indoor unit, the same control parameters of the same indoor unit frequently used by the user are used as a shortcut. When the user starts the same operation of multiple same indoor units next time, there is no need to complete the centralized control function, just start the shortcut, which is convenient for the user to control the air conditioner system with multiple indoor units.

Thus, based on the control buttons generated in the control interface in advance, multiple indoor units of the air conditioner system can be quickly controlled. Especially when the user currently only needs to control a certain function of the indoor unit, the user does not need to enter the indoor unit operation interface of the indoor unit to perform related operations, which can be done directly on the control interface with one key.

Figure 13:
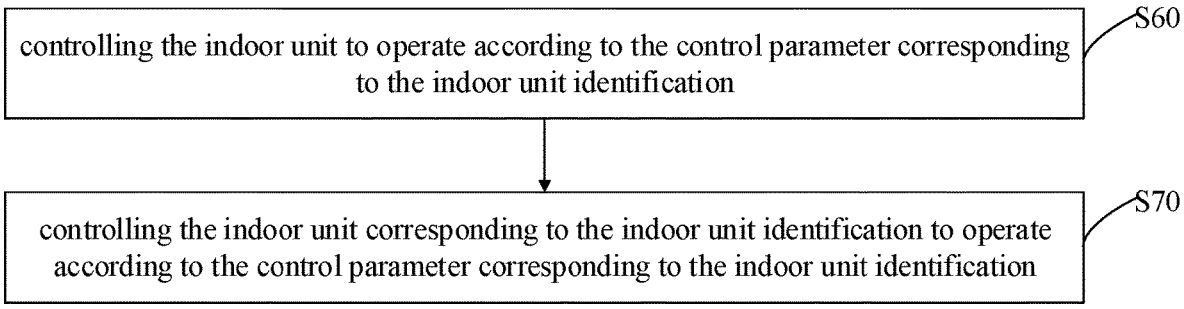
FIG. 13 is a schematic flowchart of the control method according to a sixth embodiment of the present disclosure.

In a sixth embodiment, as shown in FIG. 13, based on the embodiments as shown in FIG. 2 to FIG. 6, the quick control method of the air conditioner system includes:

Operation S50, when detecting that the control button on the control interface of the air conditioner system is triggered, obtaining the indoor unit identification and control parameters corresponding to the control button.

The air conditioner system includes multiple indoor units. Therefore, the user can control the multiple indoor units to operate simultaneously. However, when the user wants to control the multiple indoor units to operate simultaneously, it is needed to set the control parameters of the indoor units one by one, which causes inconvenience for the user to control the air conditioner system. Since when the environmental factors do not change much, the user often sets the same control parameters of the same indoor unit, the control parameters of multiple indoor units can be recorded and a control button can be generated, so that the user only needs to press the control button on the control interface of the air conditioner system to realize the control of the multiple indoor units.

In this embodiment, the control interface of the air conditioner system is displayed on the display interface of the terminal. Optionally, as shown in FIG. 9, the control interface can include a shortcut bar, and the shortcut bar can display multiple control keys. At least one control button is currently displayed on the control interface. Each control button corresponds to at least two indoor unit identifications. Each indoor unit identification has a corresponding indoor unit, that is, each indoor unit corresponds to different indoor unit identification. The indoor unit identification is used to indicate the indoor unit currently associated with the control button, that is, each control button is associated with at least two indoor units.

Optionally, the control interface of the air conditioner system can include an entry for setting indoor unit control parameters. Through the control parameter setting entrance, the user can enter the centralized control parameter setting interface of the indoor unit. In the centralized control parameter setting interface, the user can set the control parameters of multiple indoor units simultaneously. After the user sets the control parameters of at least two indoor units, the terminal controls the indoor units to operate according to the set control parameters. At this time, these indoor units are the indoor units that are controlled simultaneously. The terminal generates and displays prompt information about whether to create the control button, which is used to prompt the user whether to save the current setting of the control parameter of the indoor unit to the shortcut. When a response instruction based on the confirmation of the prompt information is received (for example, the user touches the "Yes" button of the prompt information to confirm the prompt information, and at this time, the terminal may generate a response instruction for the confirmation of the prompt information), a control button is generated on the control interface of the air conditioner system (that is, add one more control button in the shortcut bar of the control interface), and the indoor unit identification of the indoor unit controlled simultaneously and the corresponding control parameters of the indoor unit are saved to the control button. Specially, the indoor unit identification of the indoor unit is associated with the control parameters currently set by the indoor unit (or the currently executed control parameters), and the indoor unit identification of the indoor unit is associated with the control buttons (in this way, the control parameters are also corresponding to the control buttons).

When it is detected that the control button on the control interface of the air conditioner system is triggered (for example, the user presses the control button, or the user clicks the control button with the remote control or cursor), the indoor unit identification corresponding to the currently triggered control button (the user can know the indoor unit associated with the control button through the indoor unit identification) and control parameters are obtained. Each indoor unit identification has a certain control parameter associated with the control button. It should be noted that the control parameters associated with the control buttons corresponding to different indoor unit identifications may be the same or different.

Operation S60, controlling the indoor unit to operate according to the control parameter corresponding to the indoor unit identification.

After obtaining the indoor unit identification corresponding to the currently triggered control button, the indoor unit associated with the control button can be determined. The obtained control parameter corresponding to the indoor unit identification (the control parameter corresponds to the control button simultaneously) can be used as the control parameter of the indoor unit. Each indoor unit associated with the control button is controlled to operate according to the control parameter corresponding to its corresponding indoor unit identification.

It should be noted that when the terminal is an external device that controls the air conditioner system, the terminal can generate control instructions according to the control parameters corresponding to the control buttons and the indoor unit identification, and send the control instructions to the air conditioner system. After receiving the control instructions, the controller can obtain the indoor unit identification and control parameters according to the control instructions, and control the indoor unit corresponding to the indoor unit identification to operate with the control parameters. Alternatively, the terminal can generate control instructions according to the control parameters corresponding to the control buttons, and send the control instructions to the indoor unit of the air conditioner system according to the indoor unit identification corresponding to the control buttons. After receiving the control instructions, the indoor unit operates with the control parameters corresponding to the control instructions.

In this way, based on the control buttons generated in the control interface in advance, the multiple indoor units of the air conditioner system can be quickly controlled.

After the user quickly controls multiple indoor units based on the control buttons, if the user still needs to change the control parameters of individual indoor units according to actual needs, a control command for a single indoor unit can be issued. When the terminal receives a control instruction for controlling a single indoor unit, it controls the indoor unit to operate according to the control instruction. It should be noted that the indoor unit currently executing the control instruction (that is, the indoor unit that the user currently wants to control) may be the indoor unit associated with the currently triggered control button, at this time, only corresponding changes to the current control parameters of the indoor unit are made, without changing the control parameters corresponding to the indoor unit identification on the control button of the indoor unit. The indoor unit currently executing the control command may also be an indoor unit that is not associated with the currently triggered control button, at this time, while controlling the indoor unit to operate with the control parameter corresponding to the control instruction, the indoor unit associated with the control button is also controlled to continue to operate with the control parameter corresponding to the indoor unit identification.

In an embodiment, when detecting that the control button on the control interface of the air conditioner system is triggered, the indoor unit identification and control parameters corresponding to the control button are obtained, the indoor unit is controlled to operate according to the control parameter corresponding to the indoor unit identification. As such, the control parameters of each indoor unit of the air conditioner system are recorded, and the shortcut for the recorded control parameters is generated on the control interface of the air conditioner system. When the user selects the shortcut, the indoor unit associated with the shortcut is controlled to operate with the control parameters corresponding to the recorded indoor unit, such that the user only needs to perform one operation to realize the operation control of multiple indoor units, which greatly facilitates the user's quick control of the air conditioner system with multiple indoor units, and improves the efficiency of the user's simultaneous control of multiple indoor units.

Figure 14:
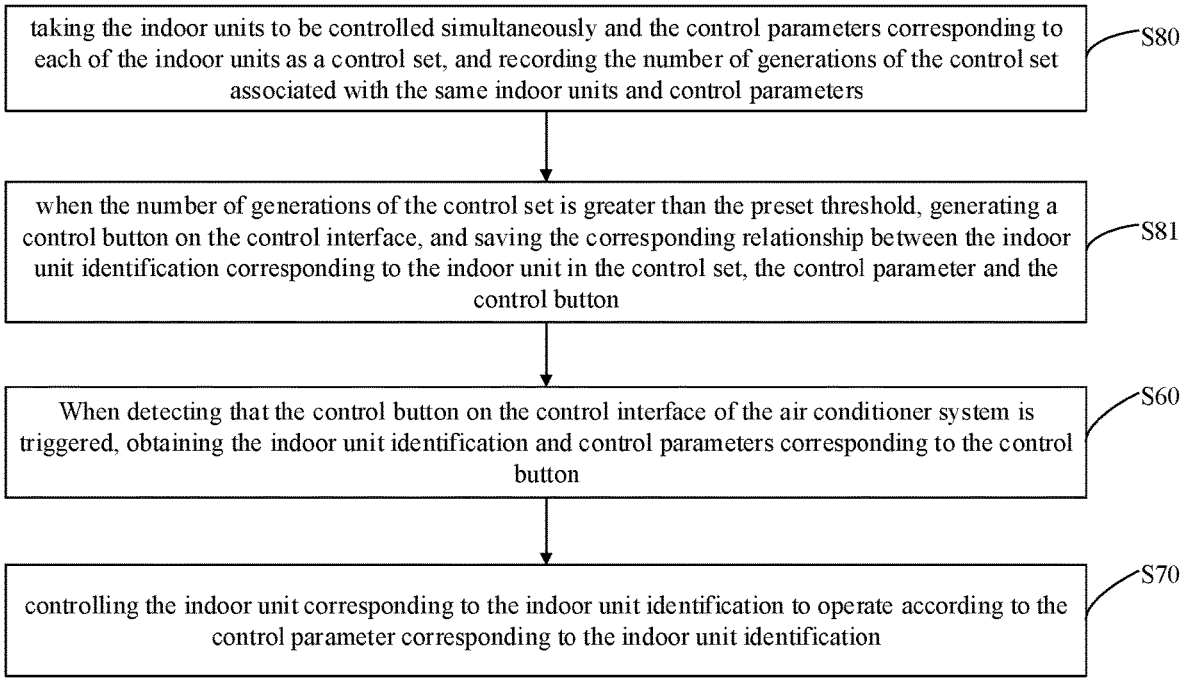
FIG. 14 is a schematic flowchart of the control method according to a seventh embodiment of the present disclosure.

In a seventh embodiment, as shown in FIG. 14, based on the embodiment shown in FIG. 13, the quick control method of the air conditioner system further includes:

Operation S80, taking the indoor units to be controlled simultaneously and the control parameters corresponding to each of the indoor units as a control set, and recording the number of generations of the control set associated with the same indoor units and control parameters.

Operation S81, when the number of generations of the control set is greater than the preset threshold, generating a control button on the control interface, and saving the corresponding relationship between the indoor unit identification corresponding to the indoor unit in the control set, the control parameter and the control button.

In this embodiment, before the user triggers the control buttons on the control interface of the air conditioner system, the terminal may pre-generate the control buttons on the control interface.

Optionally, the control interface of the air conditioner system can include an entry for setting indoor unit control parameters. Through the control parameter setting entrance, the user can enter the centralized control parameter setting interface of the indoor unit. In the centralized control parameter setting interface, the user can set the control parameters of multiple indoor units simultaneously. After the user sets the control parameters of at least two indoor units, the terminal controls the indoor units to operate according to the set control parameters. At this time, these indoor units are the indoor units that are controlled simultaneously. The terminal can record the currently set indoor unit and save the control parameters corresponding to the indoor unit, and regard the recorded indoor unit and the control parameters corresponding to the indoor unit as a control set. The control sets with the same indoor units and the same control parameters corresponding to the indoor units are regarded as the same control set. For example, the control set 1 includes indoor unit 1, indoor unit 2, indoor unit 1 corresponds to control parameter A, and indoor unit 2 corresponds to control parameter B. The control set 2 includes indoor unit 1, indoor unit 2, indoor unit 1 corresponds to control parameter A, and indoor unit 2 corresponds to control parameter B. The control set 3 includes indoor unit 1, indoor unit 2, indoor unit 1 corresponds to control parameter B, indoor unit 2 corresponds to control parameter B. In this way, control set 1 and control set 2 are the same control set, and control set 1 and control set 3 are different control sets.

The generation times of each control set as the control times of the same control parameter between each indoor unit are counted. When the number of control times of the same control parameter between each indoor unit is greater than the preset threshold, a control button is generated on the control interface of the air conditioner system (that is, add one more control button in the shortcut bar of the control interface), the indoor unit identification and control parameters corresponding to the indoor units in the control set are saved to the control button, the indoor unit identification of the indoor unit is associated with the control parameter of the indoor unit in the control set, and the indoor unit identification of the indoor unit is associated with the control button.

It should be noted that the preset threshold can be 3 times, 5 times, 10 times, or the like, optionally can be 3 times. For example, when the preset threshold is 4 times, and the number of generations of the control set 1 is 5 times, that is, the number of times of controlling the same control parameter among the indoor units in the control set is 5 times. At this time, the control button corresponding to the control set 1 is generated.

In an embodiment, the indoor units to be controlled simultaneously and the control parameters corresponding to each of the indoor units are taken as a control set, and the number of generations of the control set associated with the same indoor units and control parameters is recorded. When the number of generations of the control set is greater than the preset threshold, a control button is generated on the control interface, and the corresponding relationship between the indoor unit identification corresponding to the indoor unit in the control set, the control parameter and the control button is saved. As such, the user's setting information (or the user's usage habits) of the control parameters of the indoor unit of the air conditioner system is recorded every time. After the user performs multiple centralized control operations of the indoor unit, the same control parameters of the same indoor unit frequently used by the user are set as a shortcut. When the user needs to perform the same operation to start multiple identical indoor units next time, there is no need to complete the centralized control function, just start the shortcut, which is convenient for the user to quickly control the air conditioner system.

Figure 15:
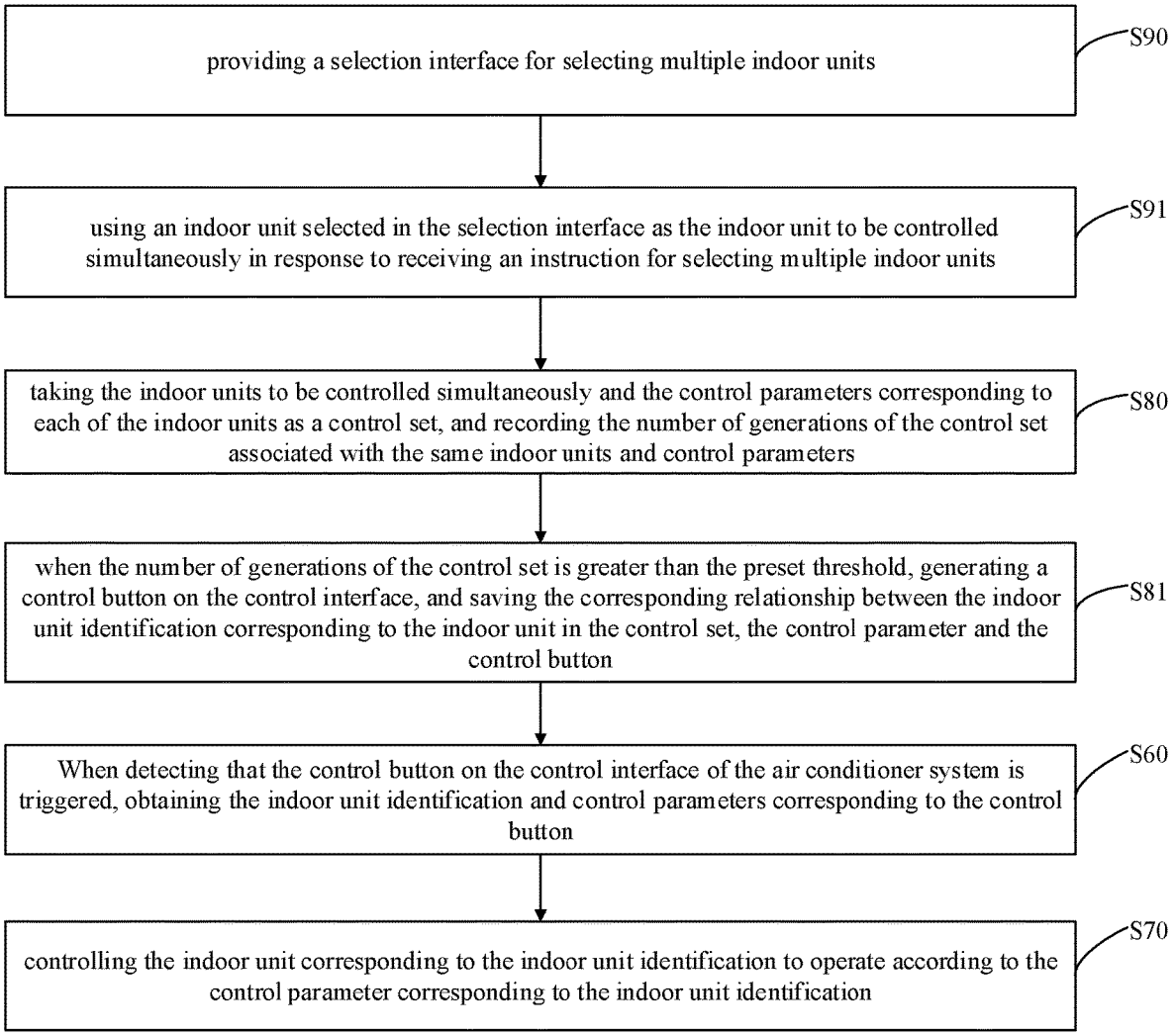
FIG. 15 is a schematic flowchart of the control method according to an eighth embodiment of the present disclosure.

In an eighth embodiment, as shown in FIG. 15, based on the embodiments as shown in FIG. 13 to FIG. 14, the quick control method of the air conditioner system further includes:

Operation S90, providing a selection interface for selecting multiple indoor units; and Operation S91, using an indoor unit selected in the selection interface as the indoor unit to be controlled simultaneously in response to receiving an instruction for selecting multiple indoor units.

In this embodiment, when entering the control interface of the air conditioner system through the APP on the mobile terminal, the terminal can first query the indoor unit connection information under the air conditioner system, such as connection data, connection status, indoor unit model, or the like. These pieces of information are displayed on the APP with graphical interaction including the selection interface of all indoor units. In this selection interface, the user can configure each indoor unit, the configuration methods include activation and silence, and operable functions include: display, control, or the like. If the user configures an indoor unit to be silent, the indoor unit will not be displayed in the extension column of the subsequent control interface. If the user configures an indoor unit to be activated, the indoor unit will be displayed in the extension column of the subsequent control interface. The indoor unit configured as silent setting is the currently selected indoor unit. When a response instruction based on the selection confirmation of the indoor unit selection interface is received, the indoor unit selected in the selection interface is regarded as the indoor unit to be controlled simultaneously.

Optionally, the control interface of the air conditioner system can include an entrance for setting the control parameters of the indoor unit, and the centralized control parameter setting interface of the indoor unit can be entered through the setting entrance for the control parameter. In this centralized control parameter setting interface, the user can set the control parameters of the indoor units currently being controlled simultaneously.

Optionally, in this centralized control parameter setting interface, the user can uniformly set the control parameters of the indoor units currently being controlled simultaneously. When the terminal receives the setting instruction of the control parameter, the setting instruction is used as the setting instruction of the control parameters of all indoor units that are controlled simultaneously. For example, the indoor units currently controlled simultaneously include indoor unit 2 and indoor unit 3. When receiving the control parameter setting as "temperature 27° C.," the control parameters of indoor unit 2 and indoor unit 3 are set to "temperature 27° C." simultaneously. In this way, the unified setting of the control parameters of multiple indoor units of the air conditioner system is realized. The user can set the control parameters of the currently selected indoor unit uniformly, and control all the selected indoor units to operate with the currently adjusted control parameters, which improves the user's efficiency in controlling multiple indoor units simultaneously.

Optionally, in the centralized control parameter setting interface, the user can respectively set the control parameters of the indoor units currently being controlled simultaneously. Specifically, the terminal respectively receives the setting instruction of the control parameter of each indoor unit controlled simultaneously, so as to respectively set the control parameter of each indoor unit.

It should be noted that, as shown in FIG. 9, it can also display the indoor units connected to the air conditioner system in the extension column of the control interface of the air conditioner system (it can be all indoor units of the air conditioner system, or multiple indoor units currently connected to the air conditioner system). The control interface has a setting entry including the control parameters of the indoor unit. Before entering the centralized control parameter setting interface through the indoor unit control parameter setting entrance, the terminal can provide an indoor unit selection interface, and when receiving a response instruction for selection confirmation, the indoor unit selected in the selection interface is regarded as the indoor unit to be controlled simultaneously, and enters the centralized control parameter setting interface (at this time, the indoor unit provided by the selection interface is the indoor unit connected to the current air conditioner system).

Figure 16:
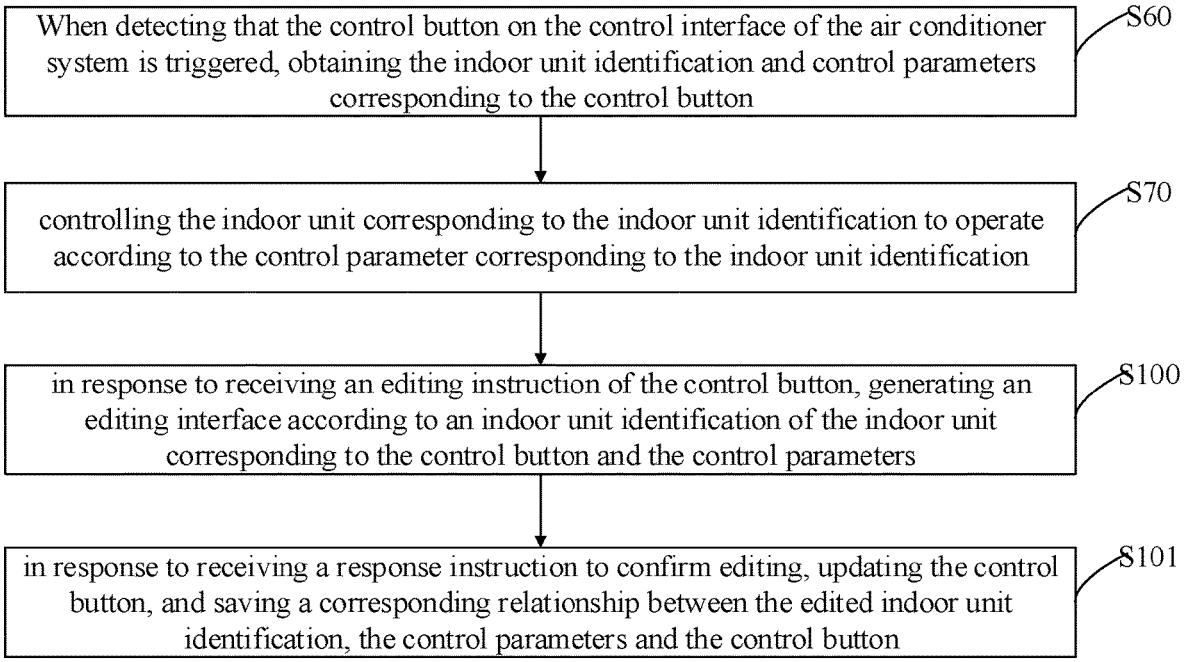
FIG. 16 is a schematic flowchart of the control method according to a ninth embodiment of the present disclosure.

In a ninth embodiment, as shown in FIG. 16, based on the embodiments shown in FIG. 13 to FIG. 15, the quick control method of the air conditioner system further includes:

Operation S100, in response to receiving an editing instruction of the control button, generating an editing interface according to an indoor unit identification of the indoor unit corresponding to the control button and the control parameters.

Operation S101, in response to receiving a response instruction to confirm editing, updating the control button, and saving a corresponding relationship between the edited indoor unit identification, the control parameters and the control button.

In this embodiment, the user can trigger the control button by short-pressing the control button, and the user can generate the editing instruction of the control button by long-pressing the control button. When receiving the edit instruction of the control button, the terminal obtains the indoor unit identification corresponding to the control button and the control parameters corresponding to each indoor unit identification, and generates an editing interface for the control button.

Figure 17:
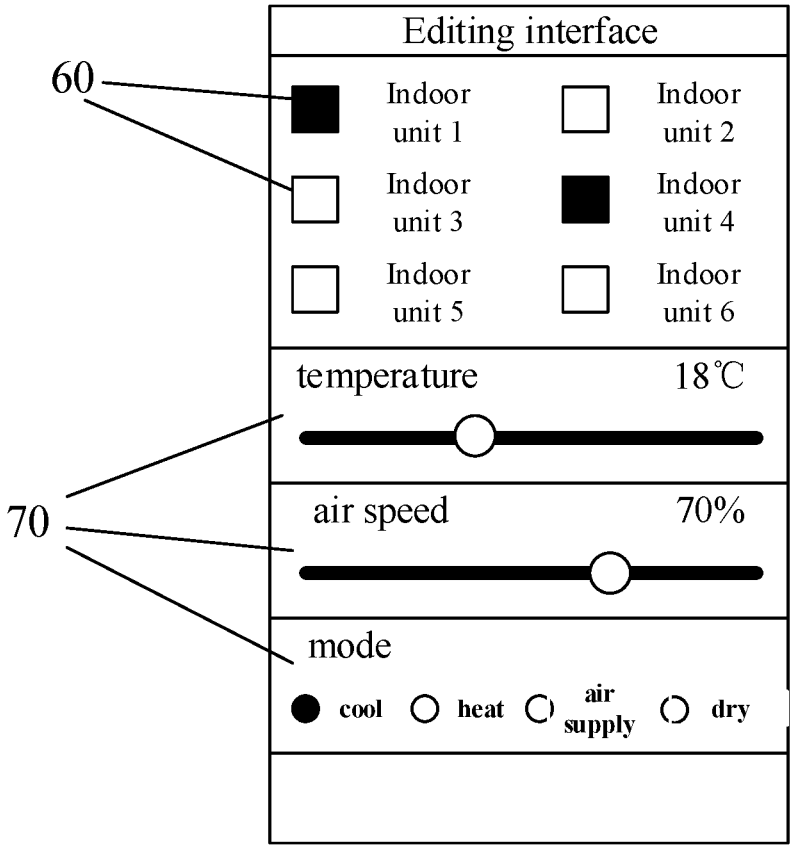
FIG. 17 is a schematic diagram of an editing interface of control buttons of the control method according to the present disclosure.

As shown in FIG. 17, the indoor unit corresponding to the acquired indoor unit identification and the control parameters are displayed on the editing interface of the control button.

Optionally, as shown in FIG. 17, the editing interface provides an option 60 for whether all indoor units are associated with the currently entered control button, and an option 70 for setting control parameters of the indoor unit. Of course, the indoor unit that is currently associated with the control button is already associated in the associated or not option, while other indoor units that are not associated with the control button are not associated in the associated or not option. The user can reset the indoor unit associated with the control button through the option of whether to associate, associate the indoor unit identification of the newly associated indoor unit with the control button, and cancel the correspondence between the indoor unit identification of the removed associated indoor unit and the control button. It should be noted that it can be in the editing interface, in the selection box corresponding to the associated option of the indoor unit, when the selection box is filled, it is associated, and when the selection box is not filled, it is not associated (it should be understood that it can also be checked or not). When the terminal detects the selection operation of the associated option, that is, when the associated operation of the associated option is detected, the indoor unit identification of the indoor unit corresponding to the associated option is used as the edited indoor unit identification.

The user can separately set the control parameters of the indoor units associated with the control buttons through the setting options of the control parameters, or uniformly set the control parameters of the indoor units associated with the control buttons. When detecting a control parameter adjustment operation triggered based on the setting option, the terminal uses the adjusted control parameter as the edited control parameter.

After the user completes the setting based on the editing interface, the user can click the setting complete button. At this time, the terminal can receive a response command to confirm editing. When receiving a response command to confirm editing, the control button is updated, and the corresponding relationship between the edited indoor unit identification, the control parameter and the control button is saved. For example, when the editing interface is generated, in the control parameters of the indoor unit, the temperature is 25° C. After the user adjusts the temperature to 18° C. based on the editing interface, after the terminal receives a response command, the control parameters of the indoor unit are saved as a temperature of 18° C. It should be noted that the change of indoor unit control parameters based on the editing interface does not affect the current control operation of each indoor unit. Instead, the control parameters of the indoor unit saved by the control button are changed, and the next time the control button is triggered, the indoor unit associated with the control button will operate according to the reset control parameters.

In an embodiment, when receiving an editing instruction of the control button, the indoor unit identification and control parameters of the control button are obtained, and an editing interface is generated. When receiving a response instruction to confirm editing, the control button is updated, and a corresponding relationship between the edited indoor unit identification, the control parameters and the control button is saved. In this way, the indoor unit associated with the control button and the adjustment of the control parameters are realized, and the flexibility of setting the indoor unit and the control parameter of the indoor unit associated with the control button is improved.

Besides, the present disclosure further provides an air conditioner system, including an outdoor unit, at least two indoor units, a memory, a processor, and a control program stored in the memory and executable on the processor, when the control program is executed by the processor, the operations of the control method described in the above embodiments are implemented.

Besides, the present disclosure further provides an air conditioner system, including a data converter, an outdoor unit, and at least two indoor units. The outdoor unit is connected to the at least two indoor units, the data converter is connected to the outdoor unit, or the data converter is connected between the outdoor unit and the at least two indoor units. The air conditioner system further includes a memory, a processor, and a control program stored in the memory and executable on the processor, when the control program is executed by the processor, the operations of the control method described in the above embodiments are implemented.

Besides, the present disclosure further provides a control device, including a memory, a processor, and a control program stored in the memory and executable on the processor, when the control program is executed by the processor, the operations of the control method described in the above embodiments are implemented.

Besides, the present disclosure further provides a computer-readable storage medium, a control program is stored in the computer-readable storage medium, and when the control program is executed by a processor, the operations of the control method described in the above embodiments are implemented.

The serial numbers of the foregoing embodiments of the present disclosure are only for description, and do not represent the advantages and disadvantages of the embodiments.

Through the description of the above embodiment, those skilled in the art can clearly understand that the above-mentioned embodiments can be implemented by software plus a needed general hardware platform, of course, it can also be implemented by hardware, but in many cases the former is a better implementation. Based on this understanding, the technical solution of the present disclosure can be embodied in the form of software product in essence or the part that contributes to the existing technology. The computer software product is stored on a storage medium (such as ROM/RAM, magnetic disk, optical disk) as described above, including several instructions to cause a terminal device (which can be a mobile phone, a computer, a server, an air conditioner, or a network device, etc.) to execute the method described in each embodiment of the present disclosure.

The present disclosure is described with reference to flowcharts and/or block diagrams of methods, devices (systems), and computer program products according to embodiments of the present disclosure. It should be understood that each process and/or block in the flowchart and/or block diagram, and the combination of processes and/or blocks in the flowchart and/or block diagram can be realized by computer program instructions. These computer program instructions can be provided to the processor of a general-purpose computer, a special-purpose computer, an embedded processor or other programmable data processing equipment to produce a machine, such that the instructions executed by the processor of a computer or other programmable data processing equipment generate a device for realizing the functions specified in one or more processes in the flowchart and/or one or more blocks in the block diagram.

These computer program instructions can also be stored in a computer-readable memory that can guide a computer or other programmable data processing equipment to work in a specific manner, such that the instructions stored in the computer-readable memory generate an article of manufacture including an instruction device that implements the functions specified in one process or multiple processes in the flowchart and/or one block or multiple blocks in the block diagram.

These computer program instructions can also be loaded on a computer or other programmable data processing equipment, so that a series of operation steps are executed on the computer or other programmable equipment to produce computer-implemented processing, thereby, the instructions executed on the computer or other programmable devices provide steps for implementing the functions specified in one or more processes in the flowchart and/or one block or more in the block diagram.

It should be noted that in the claims, any reference signs placed in parentheses should not be constructed as limitations on the claims. The word "comprising" does not exclude the presence of parts or steps not listed in the claims. The word "a" or "an" preceding a component does not exclude the presence of multiple such components. The present disclosure can be realized by means of hardware including several different components and by means of a suitably programmed computer. In the unit claims enumerating several devices, several of these devices may be embodied in the same hardware item. The use of the words first, second, and third, etc. does not indicate any order. These words can be interpreted as names.

Although the optional embodiments of the present disclosure have been described, those skilled in the art can make additional changes and modifications to these embodiments once they learn the basic creative concept. Therefore, the appended claims are intended to be interpreted as including alternative embodiments and all changes and modifications falling within the scope of the present disclosure.

Obviously, those skilled in the art can make various changes and modifications to the present disclosure without departing from the spirit and scope of the present disclosure. In this way, if these modifications and variations of the present disclosure fall within the scope of the claims of the present disclosure and their equivalent technologies, the present disclosure is also intended to include these modifications and variations.

The above are only some embodiments of the present disclosure, and do not limit the scope of the present disclosure thereto. Under the inventive concept of the present disclosure, equivalent structural transformations made according to the description and drawings of the present disclosure, or direct/indirect application in other related technical fields are included in the scope of the present disclosure.

What is claimed is:

1. A control method comprising:

obtaining historical operation records for a plurality of indoor units of an air conditioner system, the air conditioner system further including an outdoor unit;

determining control parameters of the at least two plurality of indoor units according to the historical operation records, including, for at least one indoor unit of the plurality of indoor units:

generating a control button corresponding to the control parameters on a control interface of the air conditioner system, the control button being associated with the at least one indoor unit; and in response to detecting that the control button on the control interface is triggered, obtaining the control parameters corresponding to the control button; and controlling the at least one indoor unit associated with the control button to operate with the control parameters.

2. The control method of claim 1, wherein determining the control parameters of the plurality of indoor units according to the historical operation records further includes, for one indoor unit of the plurality of indoor units:

generating a control set of the one indoor unit according to the historical operation records, the control set including at least two control functions and control parameters corresponding to the at least two control functions; and controlling the one indoor unit to operate with the control parameters in the control set.

3. The control method of claim 2, further comprising:

in response to generation of the control set, generating a prompt message about whether to generate the control button corresponding to the control set; and in response to receiving a confirmation, generating the control button on the control interface.

4. The control method of claim 2, further comprising, after controlling the one indoor unit to operate with the control parameters in the control set:

in response to an adjustment operation with respect to the control parameters of the one indoor unit, updating associated control parameters in the control set according to adjusted control parameters.

5. The control method of claim 1, wherein determining the control parameters of the plurality of indoor units according to the historical operation records further includes, for at least two indoor units of the plurality of indoor units:

generating a control set according to the historical operation records, the control set being associated with the at least two indoor units and control parameters corresponding to the at least two indoor units; and controlling the at least two indoor units to operate with the corresponding control parameters in the control set.

6. The control method of claim 5, wherein:

the control set is a second control set; and generating the second control set associated with the at least two indoor units includes:

generating a first control set of each of the at least two indoor units according to the historical operation records, the first control set including at least one control function and control parameters corresponding to the at least one control function; and generating the second control set according to the first control sets of the at least two indoor units that are controlled simultaneously.

7. The control method of claim 1, wherein:

the at least one indoor unit includes at least two indoor units of the plurality of indoor units, and the control button is associated with the at least two indoor units of the plurality of indoor units;

controlling the at least one indoor unit associated with the control button to operate with the control parameters includes:

controlling the at least two indoor units associated with the control button to operate with the control parameters.

8. The control method of claim 7, further comprising:

in response to receiving an editing instruction for the control button, generating an editing interface according to indoor unit identifications of the at least two indoor units corresponding to the control button and the control parameters; and in response to receiving a response instruction to confirm editing, updating the control button, and saving a corresponding relationship between edited indoor unit identifications, edited control parameters, and the control button.

9. The control method of claim 8, wherein:

the editing interface provides options of associating the plurality of indoor units and the control button, and in response to a selection operation of one of the options is detected, an indoor unit identification of an indoor unit corresponding to the selected option is used as one of the edited indoor unit identifications; or the editing interface provides setting options for the control parameters of the plurality of indoor units, and in response to detecting an adjustment operation for the control parameters triggered based on the setting options, adjusted control parameters are used as the edited control parameters.

10. The control method of claim 1, wherein the historical operation records include at least one of control times of the control parameters, control durations of the control parameters, control periods of the control parameters, or control environment information of the control parameters, and the control environment information includes at least one of environment temperature, environment humidity, or PM2.5 value.

11. The control method of claim 10, wherein determining the control parameters of the plurality of indoor units according to the historical operation records further includes, for one indoor unit of the plurality of indoor units:

in response to the control times of the control parameters corresponding to at least two control functions are greater than a preset threshold, and/or the control durations of the control parameters corresponding to the at least two control functions are greater than a preset duration, generating a control set of the one indoor unit, and adding control parameters corresponding to the at least two control functions to the control set;

selecting control parameters of at least two different control functions to generate the control set according to the control times or the control durations of all control parameters of the one indoor unit, each of the selected control parameters having a largest number of control times or a longest control duration among the control parameters in a corresponding one of the at least two different control functions; or selecting control parameters of at least one control function to generate the control set according to the control times or the control durations of all the control parameters of the one indoor unit, each of the selected control parameter having a largest number of control times or a longest control duration among the control parameters in a corresponding one of the at least one control function.

12. The control method of claim 11, further comprising:

when counting the control times of the control parameters, taking control times at different control environment information among the control times of the same control parameter as different control times.

13. The control method of claim 10, wherein determining the control parameters of the plurality of indoor units according to the historical operation records further includes:

obtaining a current time; and generating a control set of one indoor unit of the plurality of indoor units according to the current time, including:

in response to control periods of control parameters corresponding to at least two control functions of the one indoor unit correspond to the current time, generating the control set, and adding the control parameters corresponding to the at least two control functions to the control set; or generating the control set according to a control period of a control parameter corresponding to at least one control function within which the current time is located, and adding control parameters corresponding to the control period to the control set.

14. An air conditioner system comprising:

an outdoor unit;

a plurality of indoor units;

a memory storing a control program; and a processor configured to execute the control program to perform the control method of claim 1.

15. The air conditioner system of claim 14, further comprising:

a data converter connected to the outdoor unit or connected between the outdoor unit and the plurality of indoor units.

16. A control device comprising:

a touch display unit;

a memory storing a control program; and a processor configured to execute the control program to perform the control method of claim 1.

17. A non-transitory computer-readable storage medium storing a control program that, when executed by a processor, causes the processor to perform the control method of claim 1.

18. A control method comprising:

receiving, by at least two indoor units from a control device, control parameters, the control parameters being determined by the control device according to historical operation records of the at least two indoor units, wherein, for at least one indoor unit of the at least two indoor units, a control button corresponding to the control parameters is generated on a control interface of the control device, the control button is associated with the at least one indoor unit, and the control parameters corresponding to the control button are obtained in response to detecting that the control button on the control interface is triggered; and operating the at least one indoor unit associated with the control button, with the control parameters.

19. A control method comprising:

receiving, by an air conditioner system including at least two indoor units from a control device, indoor unit information and control parameters, the control parameters being determined by the control device according to historical operation records of the at least two indoor units, wherein, for at least one indoor unit of the at least two indoor units, a control button corresponding to the control parameters is generated on a control interface of the air conditioner system, the control button is associated with the at least one indoor unit, and the control parameters corresponding to the control button are obtained in response to detecting that the control button on the control interface is triggered; and controlling the at least one indoor unit associated with the control button to operate with the control parameters.

* * * * *